US011474482B2

(12) United States Patent
Morita et al.

(10) Patent No.: US 11,474,482 B2
(45) Date of Patent: Oct. 18, 2022

(54) ELECTRONIC WATCH

(71) Applicant: CITIZEN WATCH CO., LTD., Tokyo (JP)

(72) Inventors: Shoichiro Morita, Saitama (JP); Kazuya Imamura, Nagano (JP); Takashi Hosaka, Chiba (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 649 days.

(21) Appl. No.: 16/352,914

(22) Filed: Mar. 14, 2019

(65) Prior Publication Data

US 2019/0286061 A1 Sep. 19, 2019

(30) Foreign Application Priority Data

Mar. 14, 2018 (JP) ..... JP2018-046678
Sep. 19, 2018 (JP) ..... JP2018-174853
Sep. 19, 2018 (JP) ..... JP2018-174856

(51) Int. Cl.

*G04B 43/00* (2006.01)
*G04B 37/00* (2006.01)
*G04C 3/14* (2006.01)
*G04C 10/00* (2006.01)
*G04C 3/12* (2006.01)

(52) U.S. Cl.

CPC ..... *G04B 43/007* (2013.01); *G04C 3/12* (2013.01); *G04C 3/14* (2013.01); *G04C 10/00* (2013.01)

(58) Field of Classification Search

CPC . G04C 3/14; G04C 10/00; G04C 3/12; G04B 43/007; G04B 37/00

See application file for complete search history.

(56) References Cited

U.S. PATENT DOCUMENTS 3,911,669 A * 10/1975 Burkle ..... G04B 37/052 368/299
4,985,878 A * 1/1991 Yamada ..... G04B 37/0472 368/223
5,544,054 A 8/1996 Kayano et al.
5,936,914 A * 8/1999 Yamaguchi ..... G04C 17/02 368/205

(Continued)

FOREIGN PATENT DOCUMENTS

JP S52-67361 U 5/1977
JP H04-240587 A 8/1992

(Continued)

OTHER PUBLICATIONS

Japan Patent Office, Office Action for Japanese Patent Application No. 2018-174853, dated May 10, 2022.

(Continued)

*Primary Examiner* — Sean Kayes

(57) ABSTRACT

An electronic watch including a movement, and the movement includes a movement main body, a plate manufactured by a ferromagnetic metal, and a hook having flexibility, and the plate includes an engagement part that protrudes from the rear surface of the plate and which is configured to accommodate one end part of the hook, and the one end part of the hook is configured to be accommodated by the engagement part by elastically deforming the hook, and the other end part of the hook is fixed to the movement main body.

17 Claims, 22 Drawing Sheets

(56) References Cited

U.S. PATENT DOCUMENTS

| | | | | |
|---|---|---|---|---|
| 6,310,836 | B1 | 10/2001 | Fujii et al. | |
| 9,606,514 | B2 * | 3/2017 | Masaki | G04G 17/08 |
| 9,891,667 | B2 * | 2/2018 | Jung | G06F 1/1633 |
| 10,594,021 | B2 * | 3/2020 | Sakurasawa | G04R 60/10 |
| 2002/0114225 | A1 * | 8/2002 | Damasko | G04B 15/14 368/125 |
| 2004/0125702 | A1 * | 7/2004 | Kitajima | G04C 3/14 368/80 |
| 2004/0233789 | A1 * | 11/2004 | Oguchi | H01Q 1/273 368/47 |
| 2005/0088919 | A1 * | 4/2005 | Frey | G04B 37/1413 368/276 |
| 2008/0013409 | A1 | 1/2008 | Bland et al. | |
| 2015/0254230 | A1 * | 9/2015 | Papadopoullos | G06F 16/3331 707/739 |
| 2016/0161921 | A1 * | 6/2016 | Masaki | G04R 60/12 368/205 |
| 2016/0179055 | A1 * | 6/2016 | Momose | G04B 37/05 368/299 |
| 2016/0255733 | A1 * | 9/2016 | Jung | G04G 21/04 361/759 |
| 2018/0013189 | A1 * | 1/2018 | Sakurasawa | H01Q 1/273 |
| 2018/0224805 | A1 * | 8/2018 | Kawata | G04C 3/008 |

FOREIGN PATENT DOCUMENTS

| | | | |
|---|---|---|---|
| JP | H07-98387 | A | 4/1995 |
| JP | 2002-189087 | A | 7/2002 |
| JP | 2007-40863 | A | 2/2007 |
| JP | 2012-122932 | A | 6/2012 |
| JP | 2014-175853 | A | 9/2014 |
| WO | 00/03310 | A1 | 1/2000 |

OTHER PUBLICATIONS

Japan Patent Office, Office Action for Japanese Patent Application No. 2018-174856, dated May 10, 2022.

* cited by examiner

ELECTRONIC WATCH

CROSS-REFERENCE TO RELATED APPLICATION

This application is based upon and claims the benefits of priorities of the prior Japanese Patent Application No. 2018-46678, filed on Mar. 14, 2018, the prior Japanese Patent Application No. 2018-174853, filed on Sep. 19, 2018, and the prior Japanese Patent Application No. 2018-174856, filed on Sep. 19, 2018, the entire contents of which are incorporated herein by reference.

FIELD

The present application relates to an electronic watch.

BACKGROUND

An electronic watch includes, in general, a backing plate (or may also be referred to simply as a backing) that is a plate-shaped part for positioning and/or supporting constituent parts of a movement. Conventionally, a variety of configurations for attaching the backing plate are known. WO00/03310 has disclosed a configuration for attaching a metal plate for supporting a solar cell. A hook part bent downward is provided on the circumferential edge of the metal plate, and a hook engagement part protruding laterally is provided on a circuit support table located on the backside of the metal plate, and the metal plate is attached to the circuit support table by causing the hook part to engage with the hook engagement part.

Further, JP 04-240587 has described a technique to check the movement of a wheel train by performing reflection processing for the main plate as well as forming a hole through which light transmits into the wheel train bridge of a watch move, and by irradiating the hole in the wheel train bridge with beam light. In the technique described in JP 04-240587, since modulated light may be received at a gear in a higher ratio by reducing a beam that reflects from the main plate by performing reflection processing for the main plate, efficient inspection is enabled without focusing the beam irrespective of the fluctuations in the height of the gear.

SUMMARY

Since a user prefers a thin electronic watch from the viewpoint of design, a thin movement is necessary. Further, since it is generally desired for the electronic watch to increase antimagnetic characteristic, it is effective to manufacture the backing plate (referred to as a solar cell backing plate in WO00/03310) by a ferromagnetic metal in order to attain both a thin movement and increased antimagnetic characteristic. However, in general, the ferromagnetic metal has a comparatively low yield stress, and therefore the ferromagnetic metal is likely to deform plastically. Thus, when the backing plate is manufactured by a ferromagnetic metal with the configuration as described in WO00/03310, the backing plate may deform plastically at the time of assembly. If the backing plate deforms plastically, the magnetic properties change, and therefore it is not difficult to obtain stable antimagnetic characteristic.

One object of the present disclosure is to provide an electronic watch improving antimagnetic characteristic by using a plate manufactured by a ferromagnetic metal.

One aspect of the present disclosure is an electronic watch including a movement and the movement includes a movement main body, a plate manufactured by a ferromagnetic metal, and a hook having flexibility, and the plate includes an engagement part that protrudes from the rear surface of the plate and which is configured to accommodate one end part of the hook, and the one end part of the hook is configured to be accommodated by the engagement part by elastically deforming the hook, and the other end part of the hook is fixed to the movement main body.

The electronic watch according to the one aspect of the present disclosure is configured so that the one end part of the hook is accommodated by the engagement part of the plate by elastically deforming the hook at the time of attaching the plate. Thus, it is not necessary to deform the plate and the deformation of the plate may be suppressed, and therefore even if a plate manufactured by a ferromagnetic metal is used, plastic deformation of the plate may be prevented and further a change in magnetic properties, and therefore the antimagnetic characteristic may be improved.

BRIEF DESCRIPTION OF THE DRAWINGS

Other features and advantages of the present invention will be apparent from the ensuing description, taken in conjunction with the accompanying drawings in which.

DESCRIPTION OF EMBODIMENTS

Figure 1:
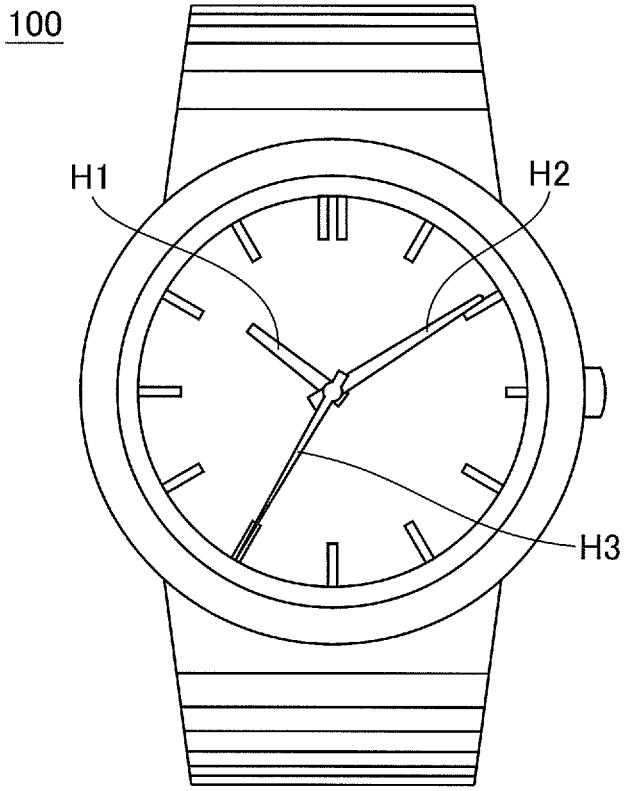
FIG. 1 is a plan view showing an electronic watch.

FIG. 1 is a plan view showing an electronic watch. An electronic watch 100 of the present disclosure is a solar cell-attached electronic watch that uses power generated by a solar cell as a drive source and a wrist watch that displays time by hands (hour hand H1, minute hand H2, and second hand H3).

Figure 2:
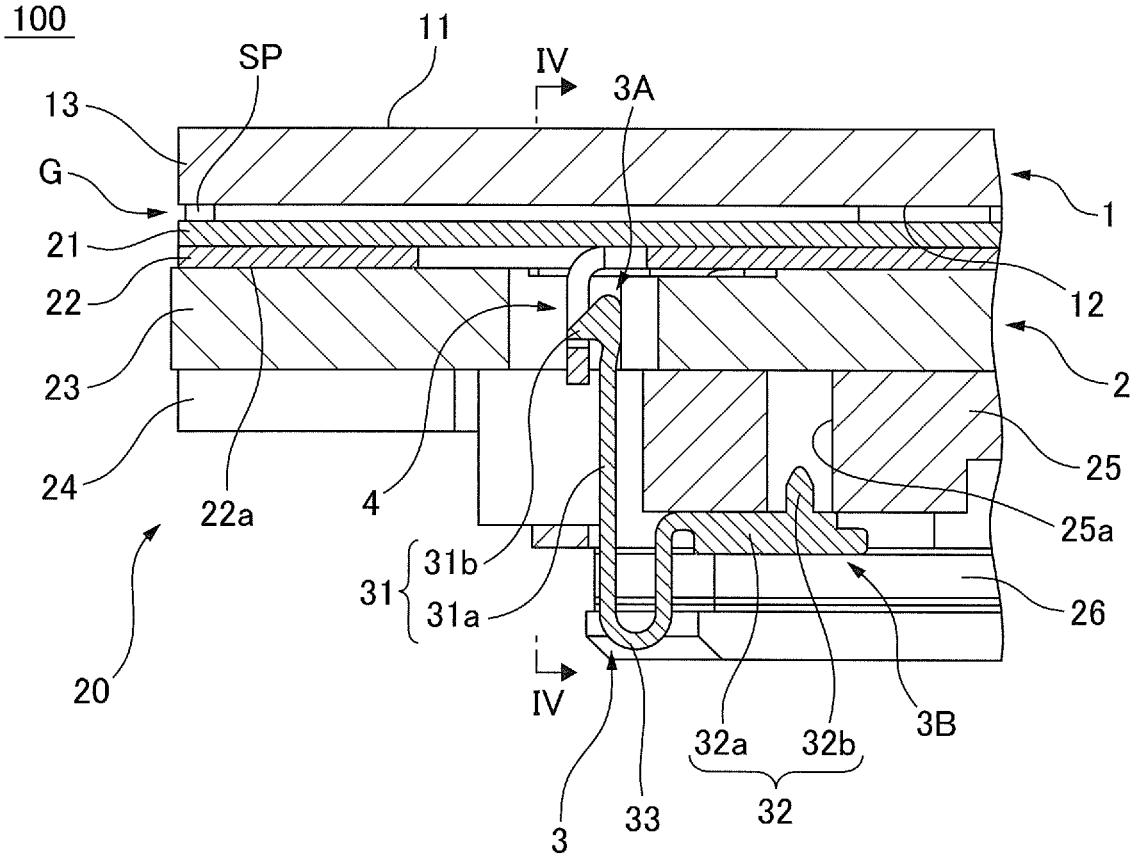
FIG. 2 is a cross-sectional view showing a part of the electronic watch in FIG. 1.

FIG. 2 is a cross-sectional view showing a part of the electronic watch in FIG. 1. The electronic watch 100 includes a dial 1 and a movement 2. In the following explanation, for convenience, the surface that displays time together with the hands on the dial 1 (upper surface in FIG. 2) is referred to as a surface 11 and the surface on the opposite side of the surface 11 is referred to as a rear surface 12. Further, in each element of the movement 2, the surface close to the dial 1 is referred to as a surface and the surface on the opposite side of the surface is referred to as a rear surface.

The dial 1 has an optically-transparent or semi-optically-transparent member 13 since a solar cell 21 (to be described later) generates power by light received by the surface 11. The terms "optical transparency" and "semi-optical transparency" in the present disclosure mean that light having a wavelength necessary for the solar cell 21 to generate power may transmit, and the member 13 includes, for example, a resin material, such as a polycarbonate resin and an acryl resin, or a glass material, a metal plate with a plurality of holes, and so on.

The movement 2 has a movement main body 20, the solar cell 21, and a solar cell backing plate 22 and the movement main body 22 includes a main plate 23, an antimagnetic plate 24, a winding stem spacer 25, and a circuit substrate 26.

The solar cell 21 is in opposition to the rear surface 12 of the dial 1. A spacer SP is arranged between the solar cell 21 and the rear surface 12 of the dial 1, and a gap G is provided between the dial 1 and the solar cell 21 in order to prevent the fine appearance of the dial 1 from degrading by showing the solar cell 12 on the dial 1 since the solar cell 21 is contacted with the dial 1. The solar cell 21 of the present disclosure is a flat plate in the shape of a circle, but the shape may be another shape, such as an ellipse and a polygon. The solar cell 21 of the present disclosure is formed by a thin material, such as a film, and pasted to the solar cell backing plate 22.

The solar cell backing plate 22 has a flat-plate shape corresponding to the solar cell 21 and supports the solar cell 21. The solar cell backing plate 22 is manufactured by a metal having a high magnetic permeability (hereinafter, referred to as a ferromagnetic metal) in order to suppress the motor that drives the hour hand H1, the minute hand H2, and the second hand H3 from becoming unable to drive due to the influence of the magnetic field from the outside. "High magnetic permeability" means that magnetism excited from the outside passes highly, and a ferromagnetic metal may be magnetized by the stress due to shape deformation (to change magnetic properties), and the magnetism of the ferromagnetic metal may bed eliminated by performing magnetic annealing. The antimagnetic plate 24 is also manufactured by a ferromagnetic metal in order to suppress the influence by the magnetic field from the outside similar to the solar cell backing plate 22, and the antimagnetic plate 24 is arranged so as to surround the winding stem spacer 25 in order to reduce the thickness of the movement 2. The winding stem spacer 25 is manufactured by a resin material.

Figure 3:
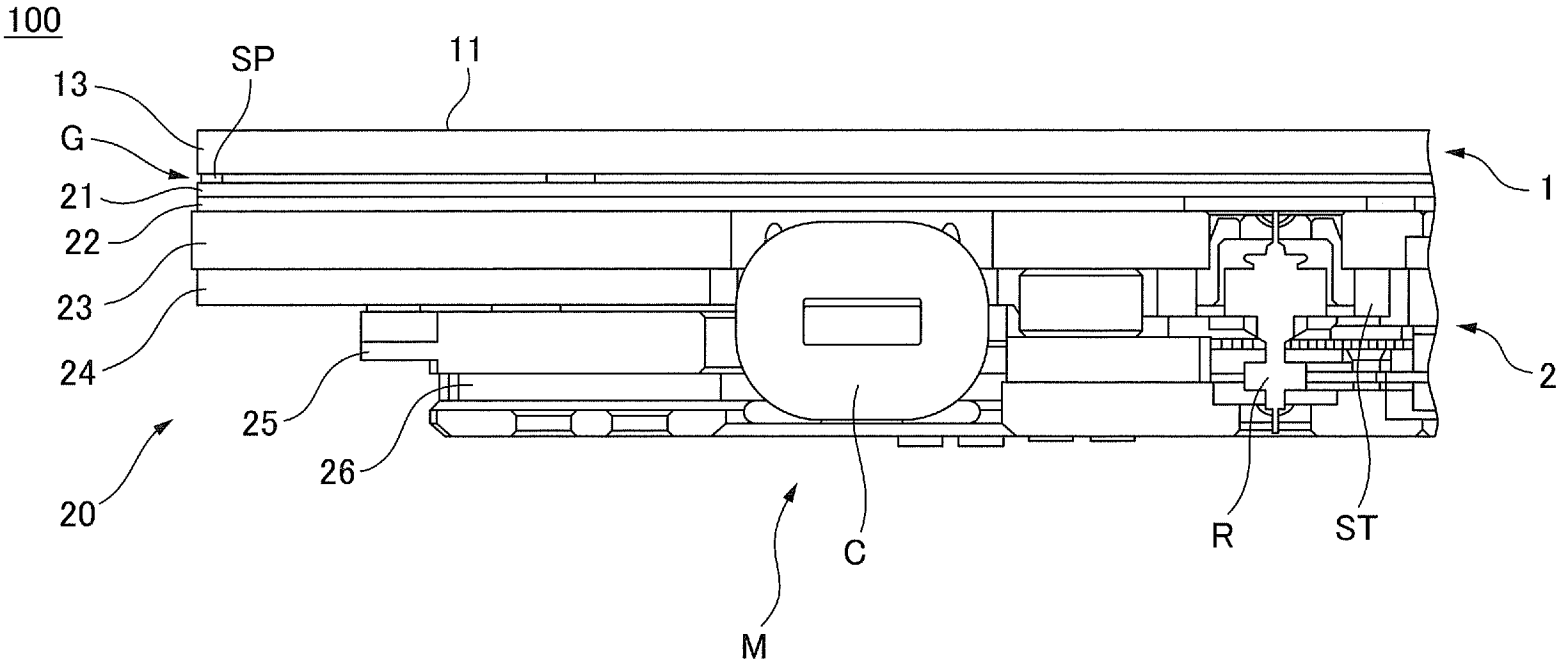
FIG. 3 is another cross-sectional view showing a part of the electronic watch in FIG. 1.

FIG. 3 is another cross-sectional view showing a part of the electronic watch in FIG. 1. The movement main body 2 further has a motor M. The motor M has a coil C, a rotor R, and a stator ST. The coil C and the stator ST are arranged in an overlapping manner with the solar cell backing plate 22 when the coil C and the stator ST are viewed from the direction (the horizontal direction in FIG. 3) perpendicular to the surface or the rear surface of the solar cell backing plate 22 (hereinafter, referred to as a plan view).

Figure 14:
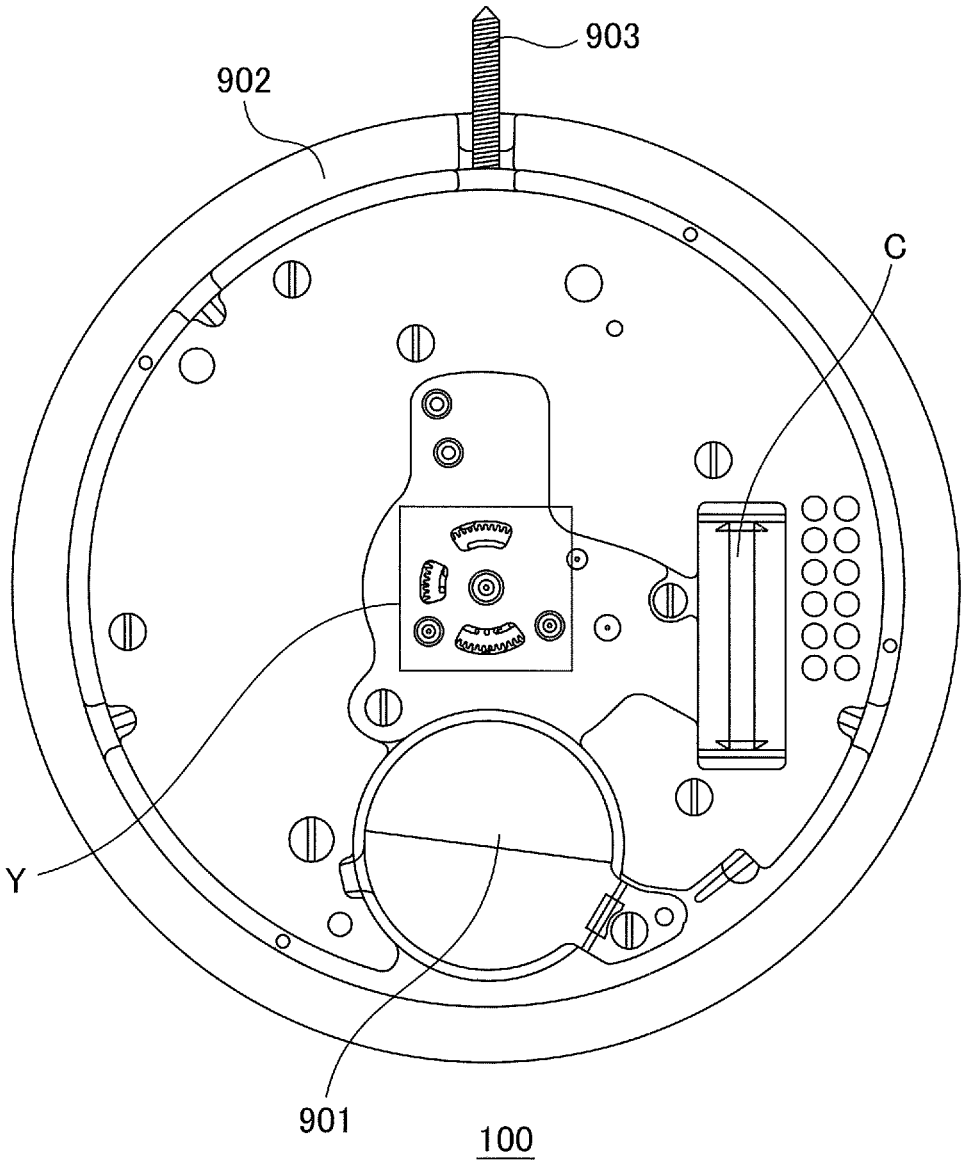
FIG. 14 is a rear view of the electronic watch whose back cover is transparent.
Figure 15:
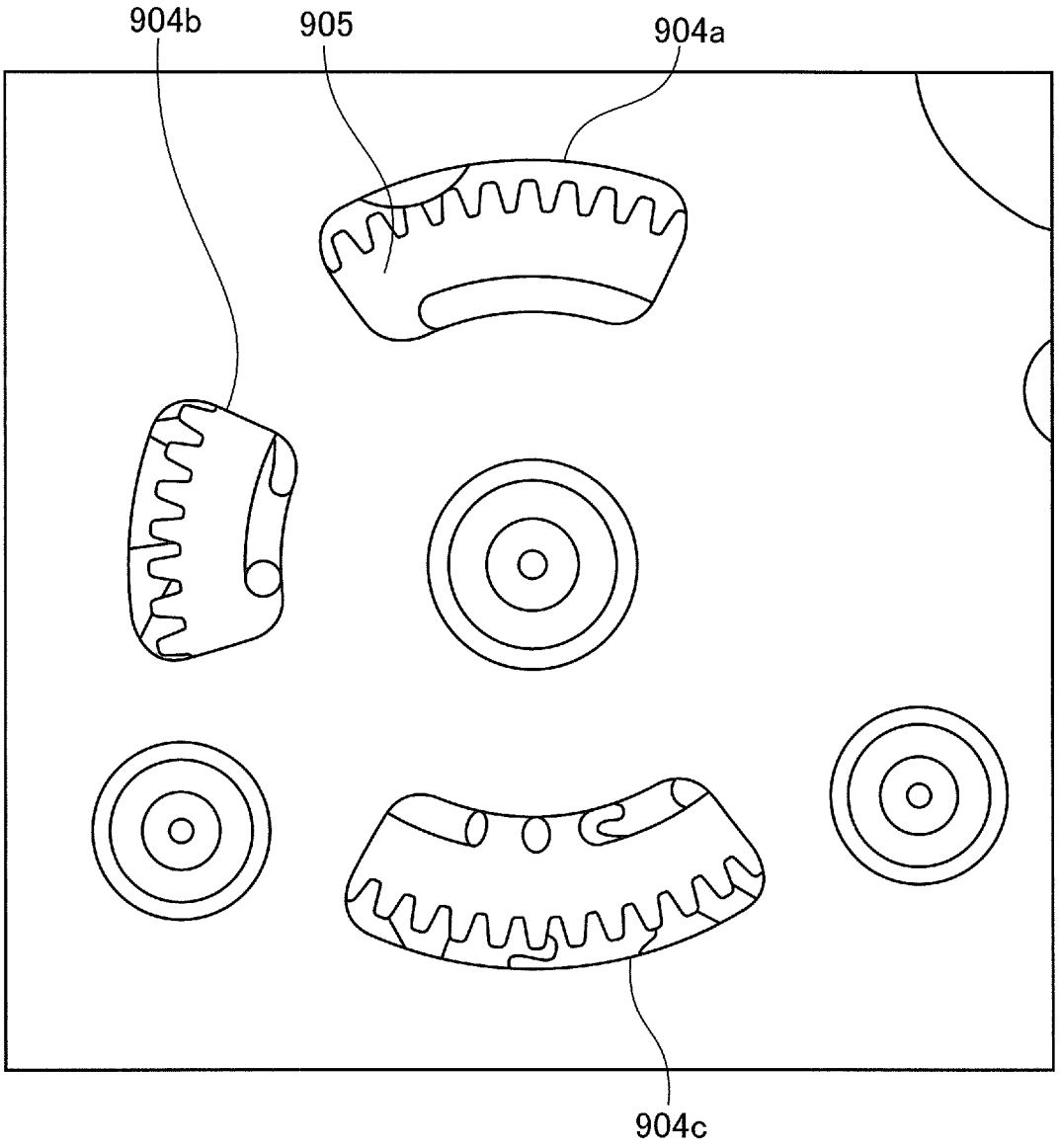
FIG. 15 is an enlarged view of an area Y.

FIG. 14 is a rear view of the electronic watch 100 whose back cover is transparent and FIG. 15 is an enlarged view of an area Yin FIG. 14. The above-described rotor R rotates wheels with which the hands (hour hand H1, the minute hand H2, and the second hand H3) displaying time are engaged via gears including a second wheel 905. The second hand H3 is engaged and connected with the second wheel 905 and the second wheel 905 rotates six times a second. Further, holes 904*a*, 904*b*, and 904*c* are formed on the wheel train bridge, it may be visually recognized that the watch is operating when the back cover is formed by a transparent member, such as glass.

Referring to FIG. 2, the movement 2 further has a hook 3 and an engagement part 4 provided on the solar cell backing plate 22 as an attachment structure of the solar cell backing plate 22.

The hook 3 includes a first portion 31 including a first end part 3A of the hook, a second portion 32 including a second end part 3B of the hook, and a curved part 33 between the first portion 33 and the second portion 32.

The first portion 31 includes an elongated straight line portion 31*a* and a protruding part 31*b* protruding from the straight line portion 31*a* approximately perpendicularly. The straight line portion 31*a* is longer than the engagement part 4 in the lengthwise direction thereof. The second portion 32 includes a straight line portion 32*a* and a protruding part 32*b* protruding from the straight line portion 32*a* approximately perpendicularly. The curved part 33 has an approximate U-letter shape and has flexibility. The straight line portion 31*a* of the first portion 31 extends from one end part of the U letter of the curved part 33 in parallel to the straight line portion of the U letter and the straight line portion 32*a* of the second portion 32 extends from the other end part of the U letter of the curved part 33 perpendicularly to the straight line portion of the U letter. When the length of the first portion 31 is sufficient to have flexibility, the U-letter-shaped curved part 33 is not necessary (for example, see FIG. 13).

Figure 4:
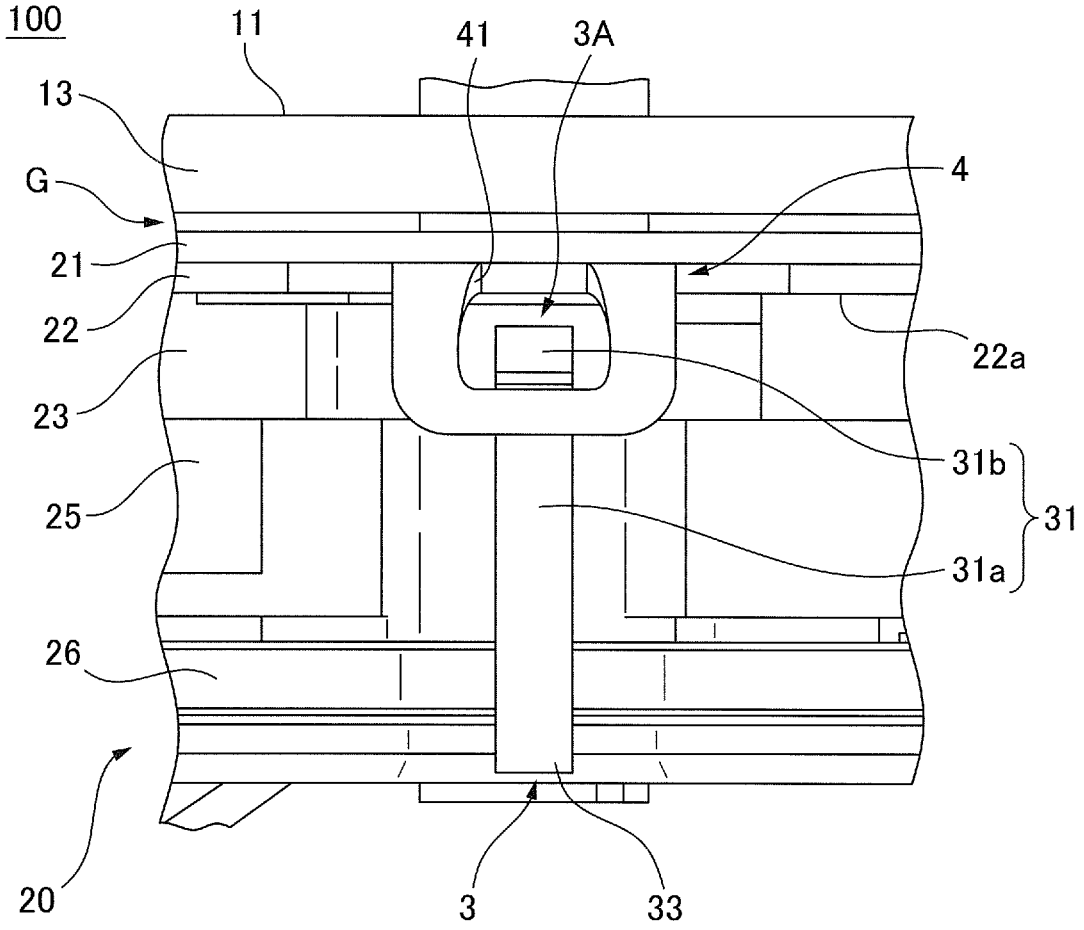
FIG. 4 is a cross-sectional view taken along an IV-IV line in FIG. 2.

The engagement part 4 is provided inside the outer circumferential edge of the solar cell backing plate 22. FIG. 4 is a cross-sectional view taken along an IV-IV line in FIG. 2. The engagement part 4 protrudes in the direction of a rear surface 22*a* from the solar cell backing plate 22 and includes a hole 41. The hole 41 accommodates the first end part 3A (specifically, the protruding part 31*b*) of the hook 3.

Referring to FIG. 2, the second end part 3B of the hook 3 is fixed between the winding stem spacer 25, which is an insulating member, and the circuit substrate 26. The winding stem spacer 25 has a hole 25*a* and the protruding part 32*b* of the hook 3 is inserted into the hole 25*a*.

The engagement part 4 is manufactured by a ferromagnetic metal as a part of the solar cell backing plate 22, and therefore when the engagement part 4 deforms, the magnetic properties of the entire solar cell backing plate 22 will change. Further, in general, a ferromagnetic metal has a comparatively low yield stress, and therefore the ferromagnetic metal easily deforms plastically. Thus, the present embodiment is designed so that the deformation of the engagement part 4 is prevented by the hook 3 having flexibility higher than that of the engagement part 4.

Specifically, the hook 3 is designed so as to displace the first end part 3A by elastically deforming the curved part 33 so that each of the pair of straight line parts of the U letter of the curved part 33 comes close to each other, and therefore the first end part 3A may be accommodated in the hole 41 of the engagement part 4 without deforming the solar cell backing plate 22. Further, since the first portion 31 of the hook 3 has the elongated straight line portion 31*a*, a large bending torque acts by the curved part 33 from the first end part 3A of the hook 3, and therefore the curved part 33 may be elastically deformed easily.

The hook 3 of the present disclosure is manufactured by an electrically conductive material, such as metal, as a part separate from the other elements, but electrically insulated from the circuit substrate 26.

Figure 5:
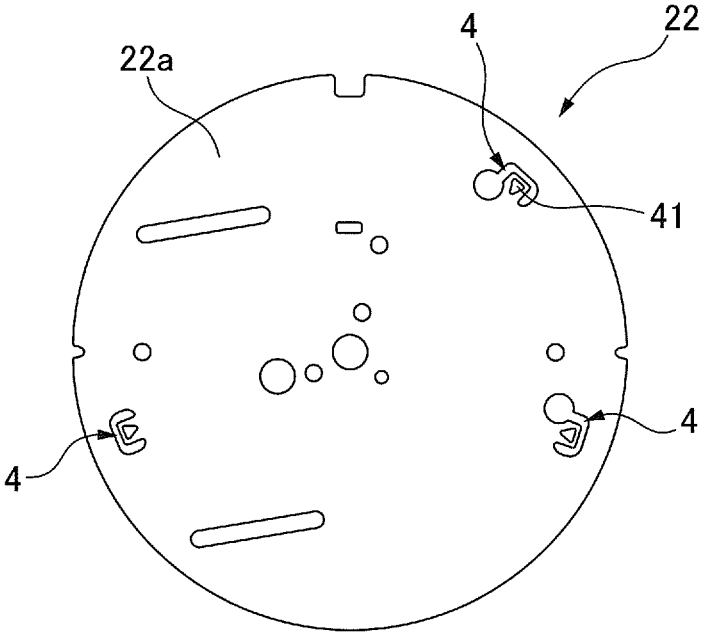
FIG. 5 is a bottom view showing a solar cell backing plate after press molding and before embossing.
Figure 6:
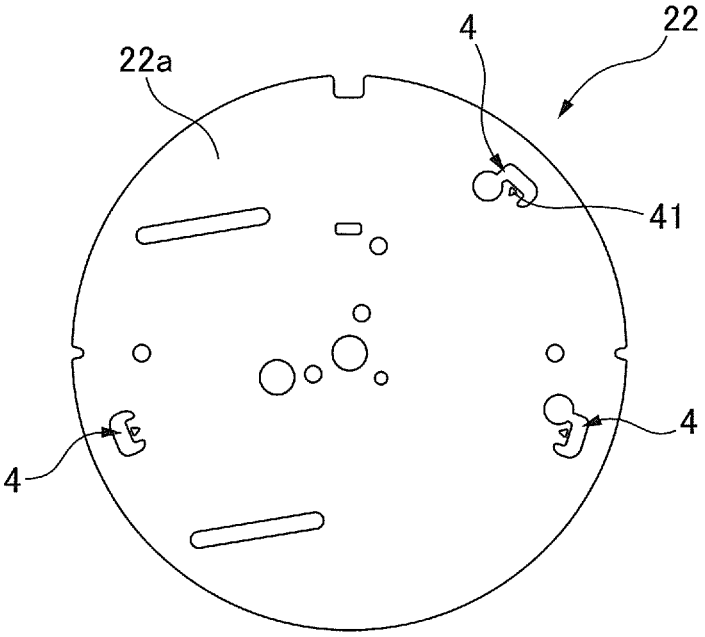
FIG. 6 is a bottom view showing a solar cell backing plate on which an engagement part is formed.

Next, a manufacturing method of the solar cell backing plate 22 is explained. FIG. 5 is a bottom view showing a developed shape of the solar cell backing plate before bending machining and FIG. 6 is a bottom view showing the solar cell backing plate on which the engagement part is formed. The engagement part 4 may be simultaneously formed at the same time as manufacturing the solar cell backing plate 22. First, as shown in FIG. 5, the engagement part 4 still flush with the plate material is formed by performing press molding for a plate material. Next, the engagement part 4 is bent and protrudes from the rear surface 22*a* as shown in FIG. 6 by embossing the plate material in FIG. 5, and the change in the magnetic properties of the entire solar cell backing plate 22 is cancelled by annealing in the state in FIG. 6. Then, the engagement part 4 is formed. The solar cell backing plate 22 of the present disclosure is provided with a plurality of the engagement parts 4.

Figure 7:
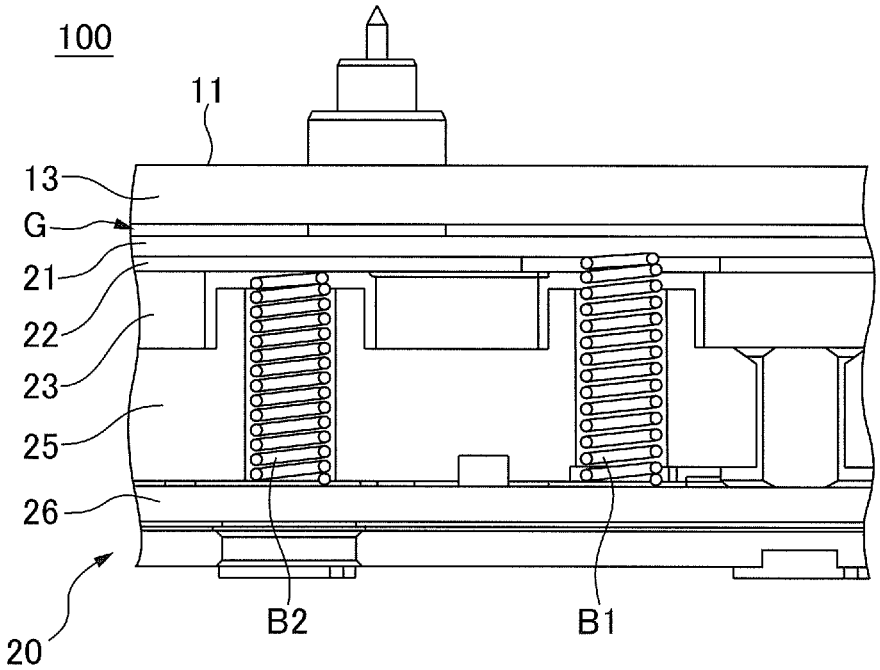
FIG. 7 is still another cross-sectional view showing a part of the electronic watch in FIG. 1.
Figure 8:
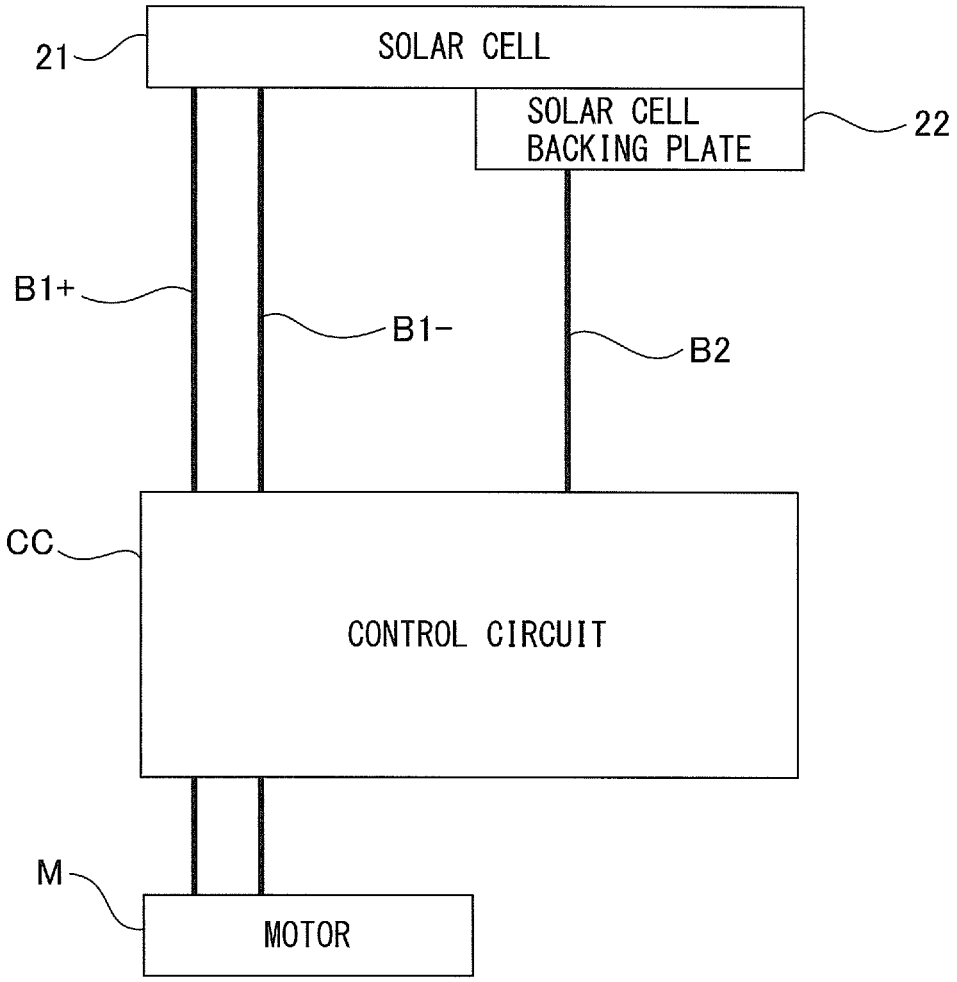
FIG. 8 is a view showing a circuit configuration of the electronic watch in FIG. 1.

Next, an electric connection relationship between the solar cell 21 and the circuit substrate 26 is explained. FIG. 7 is a cross-sectional view showing another part of the electronic watch in FIG. 1 and FIG. 8 is a view showing the circuit configuration of the electronic watch in FIG. 1. The movement 2 further has a solar cell connection spring B1 and an antenna connection spring (spring member) B2.

The solar cell connection spring B1 electrically connects the solar cell 21 and a control circuit CC in the circuit substrate 26 and sends power generated by the solar cell 21 to the control circuit CC. The solar cell connection spring B1 includes a solar cell connection spring B1+ on the plus side and a solar cell connection spring B1− on the minus side.

The antenna connection spring B2 electrically connects the solar cell backing plate 22 and the control circuit CC in the circuit substrate 26, and therefore the solar cell backing plate 22 may be set to a predetermined electric potential, and therefore the solar cell backing plate 22 may be used as an antenna and the control circuit CC may perform communication by capacitive coupling with an external communication device via the solar cell backing plate 22. Further, in the present disclosure, although the antenna connection spring B2 electrically connects the solar cell backing plate 22 and the control circuit CC, the solar cell backing plate 22 and the control circuit CC may be electrically connected by using the hook 3.

In the electronic watch 100 of the present disclosure as described above, since the one end part 3A of the hook 3 is accommodated in the engagement part 4 of the solar cell backing plate 22 by elastically deforming the hook 3 at the time of attaching the solar cell backing plate 22 the deformation of the solar cell backing plate 22 may be suppressed. Thus, even if the solar cell backing plate 22 manufactured by a ferromagnetic metal is used, the plastic deformation of the backing plate and a change in the magnetic properties may be prevented, and the antimagnetic characteristic may be improved.

Further, in the electronic watch 100, when viewed in a plan view, the solar cell backing plate 22 and at least a part of the motor M are arranged in an overlapping manner. Thus, the antimagnetic characteristic may be further improved.

Further, in the electronic watch 100, the hook 3 has flexibility higher than that of the engagement part 4. Thus, the engagement part 4 is more unlikely to deform than the hook 3, and therefore the deformation of the solar cell backing plate 22 may be further suppressed. Thus, the antimagnetic characteristic may be further improved.

Further, in the electronic watch 100, the solar cell backing plate 22 supports the solar cell 21. Thus, the solar cell 21 may be fixed.

Further, in the electronic watch 100, the movement 2 has the spring member B2 that electrically connects the circuit substrate 26 of the movement main body 20 and the solar cell backing plate 22. Thus, the solar cell backing plate 22 may be used as an antenna (for example, antenna for measuring the rate). Further, stable communication is enabled by the spring being used as a connecting member.

Next, another embodiment of the electronic watch is explained.

Figure 9:
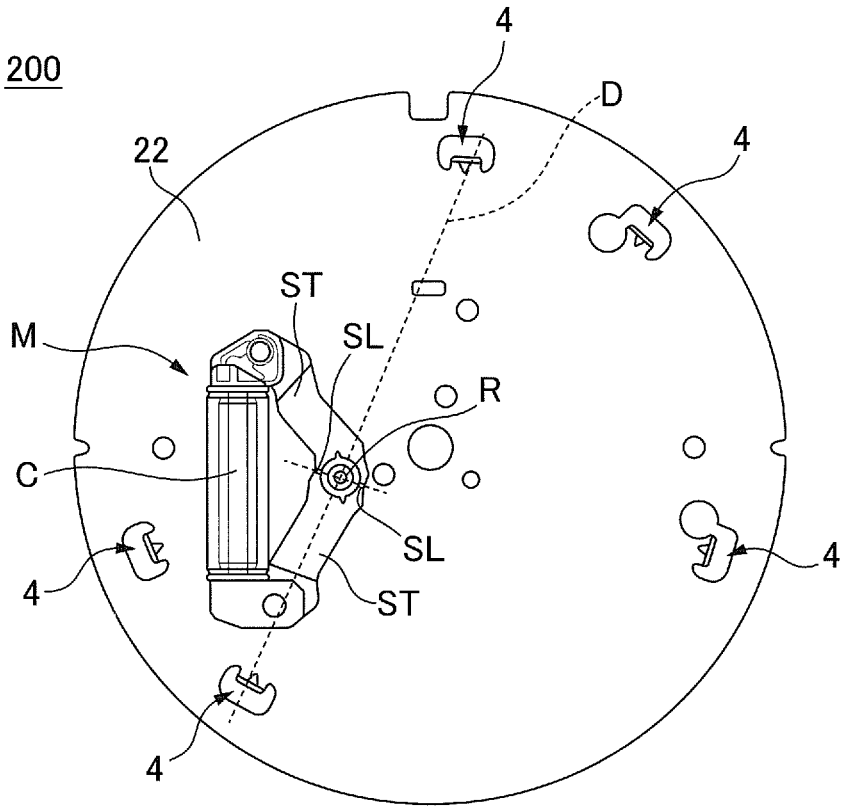
FIG. 9 is a plan view showing a solar cell backing plate of an electronic watch according to another embodiment together with a motor.

FIG. 9 is a plan view showing a solar cell backing plate of an electronic watch according to another embodiment together with a motor. An electronic watch 200 differs from the electronic watch 100 described above in that the engagement part 4 is further arranged in a direction D in which the motor M is most affected by the magnetic field applied from the outside. In FIG. 9, it should be noted that elements other than the solar cell backing plate 22 and the motor M are omitted in order to clearly understand the solar cell backing plate 22 and the motor M.

In the motor M, the magnetic field from the coil C is generated along the stator ST. On the periphery of the rotor R, the stator ST is provided with slits SL so that more magnetic flux lines pass through the rotor R. The direction perpendicular to the slit SL is defined as the direction D in which the motor M is most affected by the magnetic field applied from the outside. In the electronic watch 200 of the present disclosure, the two engagement parts 4 are arranged in the direction D so that the rotor R is arranged between the two engagement parts 4.

Figure 10:
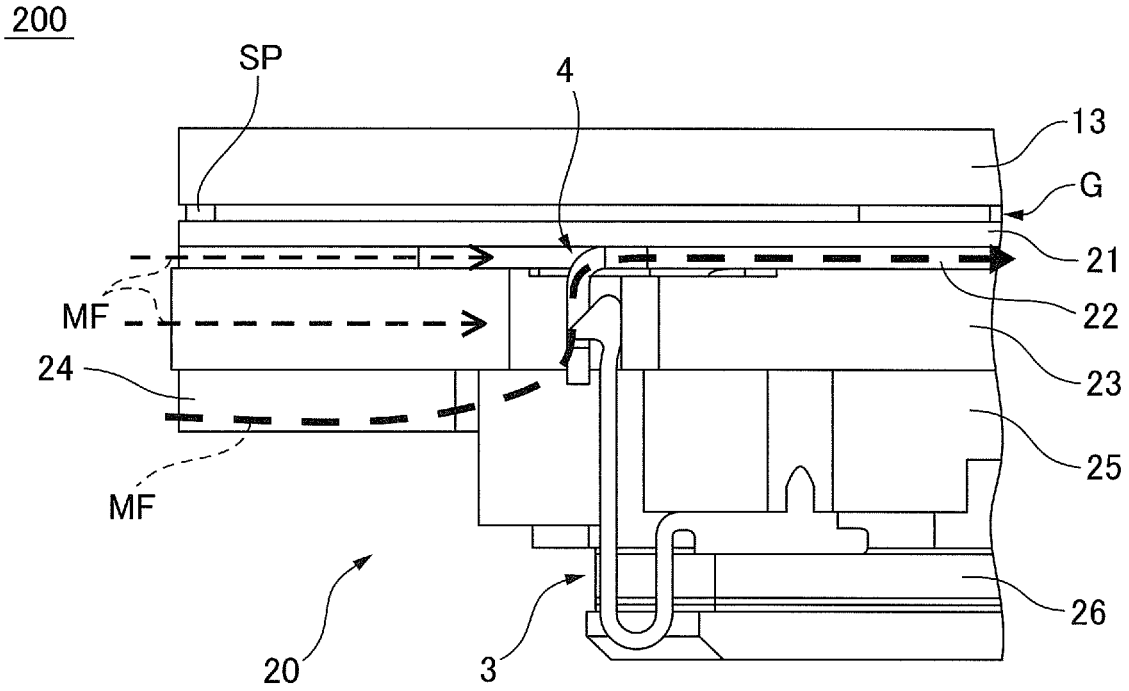
FIG. 10 is a cross-sectional view showing a part of the electronic watch along a direction D in FIG. 9.

FIG. 10 is a cross-sectional view showing a part of the electronic watch along the direction D in FIG. 9. When the magnetic field along the direction D is applied to the electronic watch 200 from the outside, a magnetic flux flow MF passes through the solar cell backing plate 22 via the engagement part 4 manufactured by a ferromagnetic metal. Thus, the magnetic flux flow MF is suppressed from passing through the rotor R.

The electronic watch 200 of the present disclosure as described above may bring about approximately the same effect as that of the electronic watch 100 described above. Further, in the electronic watch 200, when viewed in a plan view, the engagement part 4 is arranged in the direction D in which the motor M is most affected by the magnetic field applied from the outside. Thus, the magnetic flux flow MF from the outside passes through the solar cell backing plate 22 via the engagement part 4 manufacture by a ferromagnetic metal, and therefore the magnetic flux flow MF is suppressed from passing through the rotor R. Thus, the magnetic characteristic may be further improved.

Next, still another embodiment of the electronic watch is explained.

Figure 11:
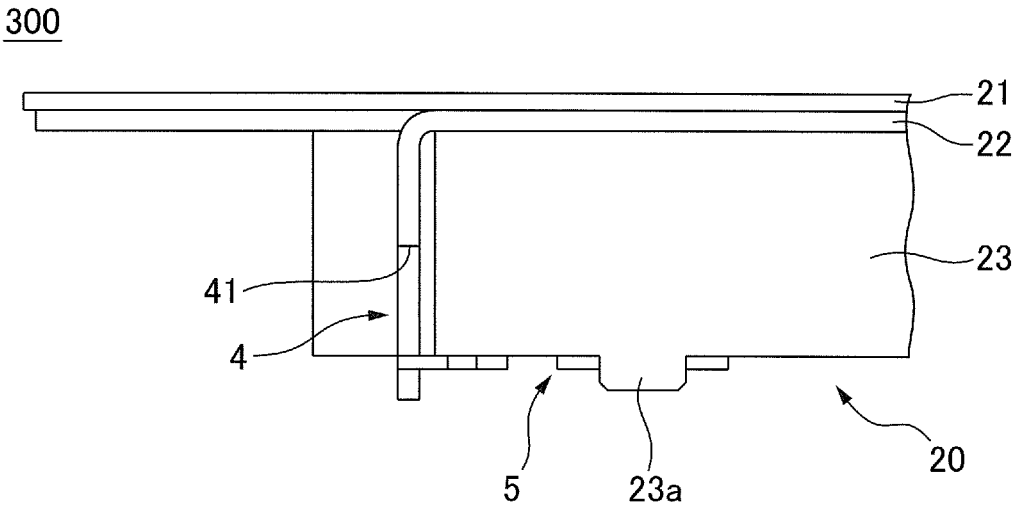
FIG. 11 is a partial cross-sectional view of an electronic watch according to still another embodiment.

FIG. 11 is a partial cross-sectional view of an electronic watch according to still another embodiment. An electronic watch 300 differs from the electronic watch 100 described above in that a hook 5 is fixed by being sandwiched by the main plate 23, which is an insulating member, and the winding stem spacer 25 (in FIG. 11, the winding stem spacer 25 is not shown schematically). The hook 5 is arranged on the bottom of the main plate 23 and has a flat shape along the bottom of the main plate 23.

Figure 12:
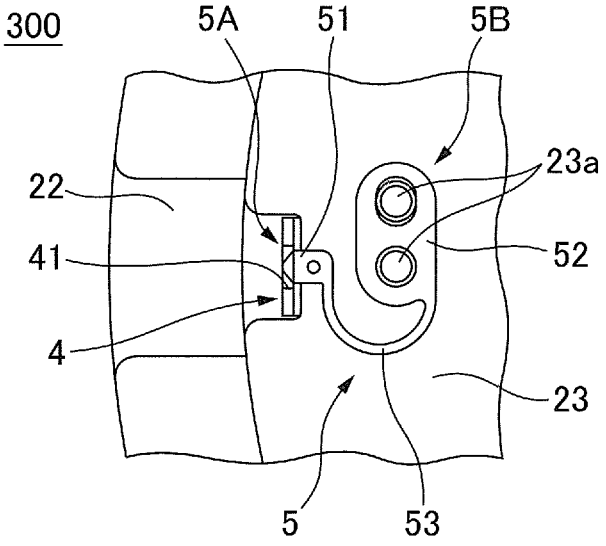
FIG. 12 is a bottom view of the electronic watch in FIG. 11.

FIG. 12 is a bottom view showing the solar cell backing plate and the hook of the electronic watch in FIG. 11. The hook 5 includes a first portion 51 including a first end part 5A of the hook 5, a second portion 52 including a second end part 5B of the hook 5, and a curved part 53 located between the first portion 51 and the second portion 52 and having an approximate arc shape.

The first portion 51 is linked to one end part of the arc of the curved part 53. The tip part of the first portion 51 is tapered when viewed in a plan view. Further, the tip part of the first portion 51 may have a taper also when viewed from the side (when viewed from the direction perpendicular to the paper surface in FIG. 11). The tip part of the first portion 51 is inserted into the hole 41 of the engagement part 4, and therefore the one end part 5A of the hook 5 is fixed to the engagement part 4.

The second portion 52 is linked to the other end part of the arc of the curved part 53. In the second portion 52, a plurality of through holes is formed, and protruding parts 23*a* provided on the bottom of the main plate 23 are fitted into these through holes, and therefore the other end part 5B of the hook 5 is fixed to the main plate 23. The curved part 53 has flexibility.

The hook 5 is configured so as to displace the first end part 5A by elastically deforming the curved part 53 so that both end parts of the arc of the curved part 53 come close to each other, and therefore the first end part 5A may be accommodated in the hole 41 of the engagement part 4 without deforming the solar cell backing plate 22. Thus, although the hook 3 of the electronic watch 100 obtains elasticity by the elongated straight line portion 31*a*, and the thickness of the movement 2 is restricted, the hook 5 of the electronic watch 300 of the present disclosure may obtain elasticity by extending the curved part 53 in the plane direction, and therefore the thickness of the movement 2 may be further reduced.

The electronic watch 300 of the present disclosure as described above may bring about approximately the same effect as that of the electronic watch 100 described above. Further, in the electronic watch 300, the hook 5 has a flat, compact shape, and therefore the amount of the material of the hook 5 may be reduced.

Next, still another embodiment of the electronic watch is explained.

Figure 13:
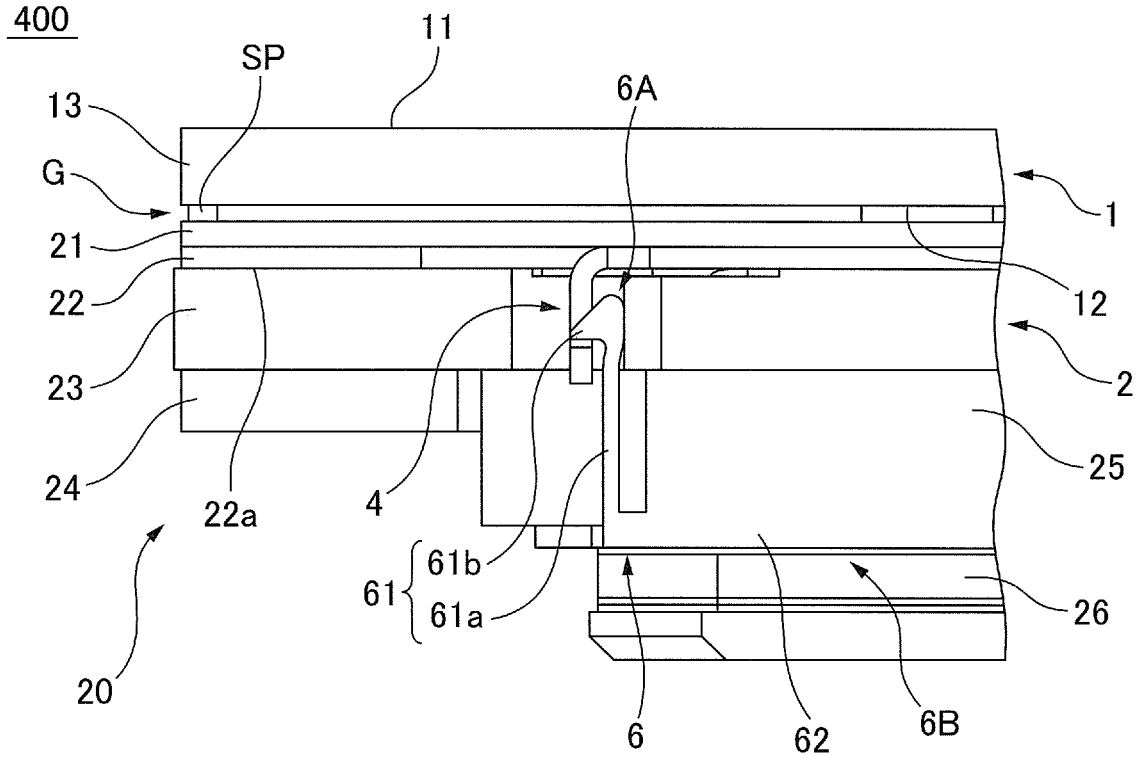
FIG. 13 is a partial cross-sectional view of an electronic watch according to still another embodiment.

FIG. 13 is a partial cross-sectional view of an electronic watch according to still another embodiment. An electronic watch 400 differs from the electronic watch 100 described above in that a hook 6 is manufactured into one unit together with the winding stem spacer 25 by a resin material.

The hook 6 includes a first portion 61 including a first end part 6A of the hook 6 and a second portion 62 including a second end part 6B of the hook 6.

The first portion 61 is configured in a manner approximately similar to that of the first portion 31 described above and includes an elongated straight line portion 61*a* and a protruding part 61*b* protruding approximately perpendicularly from the straight line portion 61A. The straight line portion 61*a* is longer than the engagement part 4 in the lengthwise direction thereof. One end part of the second portion 62 is linked to the end part of the straight line portion 61*a* and the other end part of the second portion 62 is formed into one unit together with the bottom of the winding stem spacer 25, which is an insulating member.

In the hook 6, the elongated straight line portion 61*a* has flexibility and is configured so as to displace the first end part 6A by elastically deforming the straight line portion 61*a* by pressing the straight line portion 61*a* or the protruding part 61*b*, and therefore the first end part 6A (specifically, the protruding part 61*b*) may be accommodated in the hole 41 of the engagement part 4 without deforming the solar cell backing plate 22.

The electronic watch 400 of the present disclosure as described above may bring out approximately the same effect as that of the electronic watch 100 described above. Further, in the electronic watch 400, the hook 6 and the winding stem spacer 25 are manufactured into one unit, and therefore the number of parts may be reduced and the electronic watch 100 can be easily assembled.

Next, still another embodiment of the electronic watch is explained.

Figure 16:
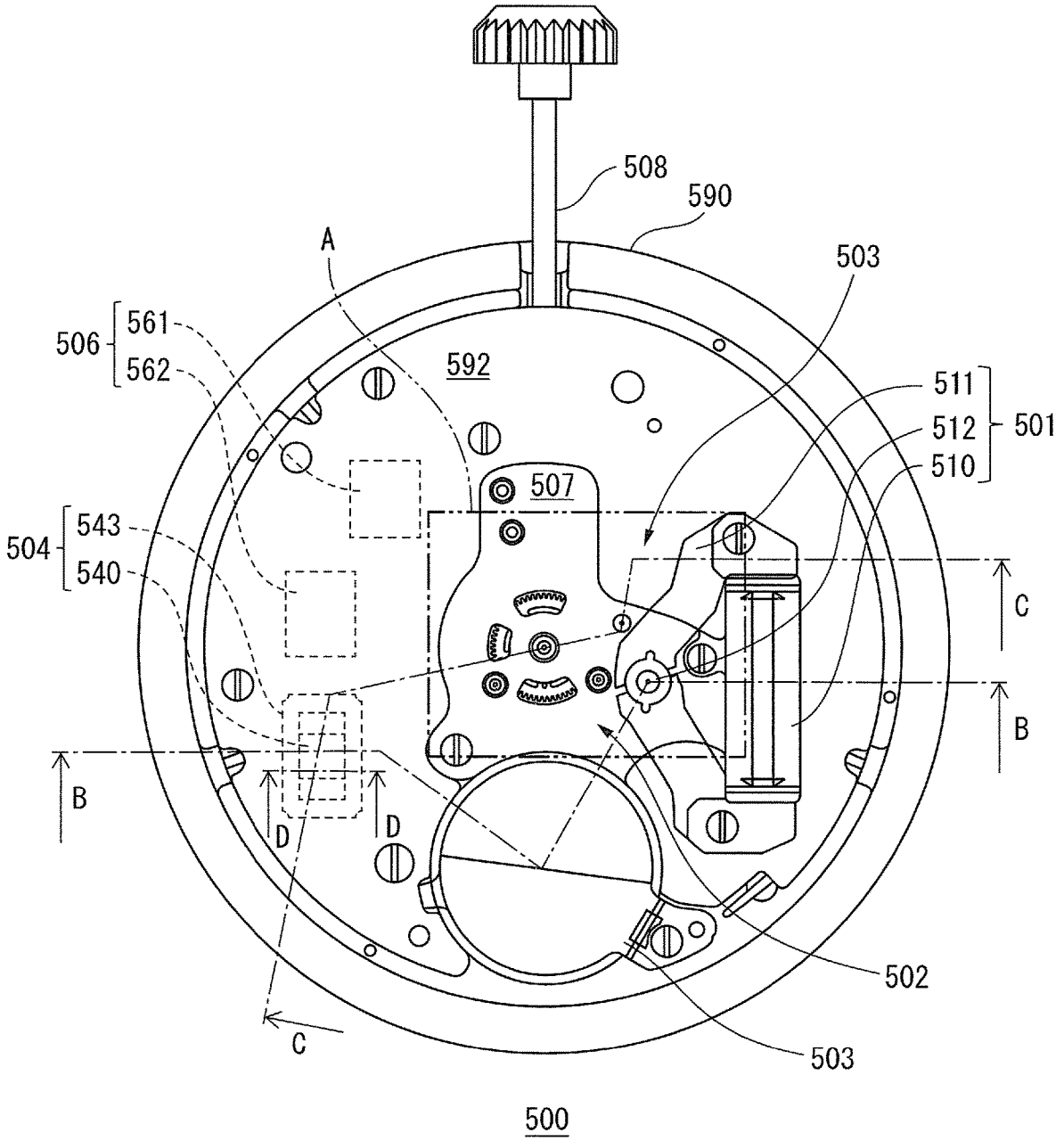
FIG. 16 is a rear view of an electronic watch whose back cover is transparent according to still another embodiment.
Figure 17:
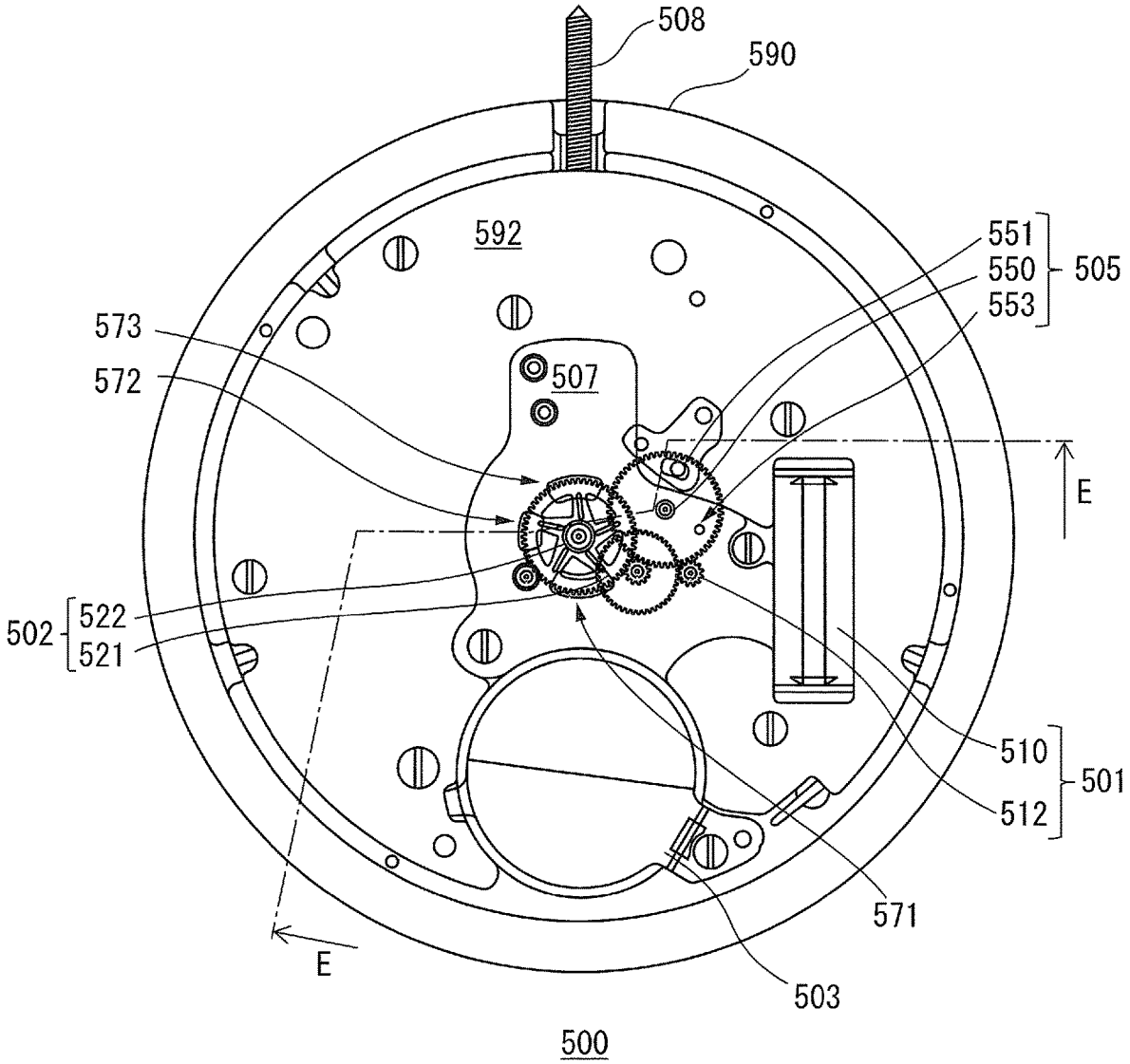
FIG. 17 is a perspective view of a wheel train of the electronic watch shown in FIG. 16.
Figure 18:
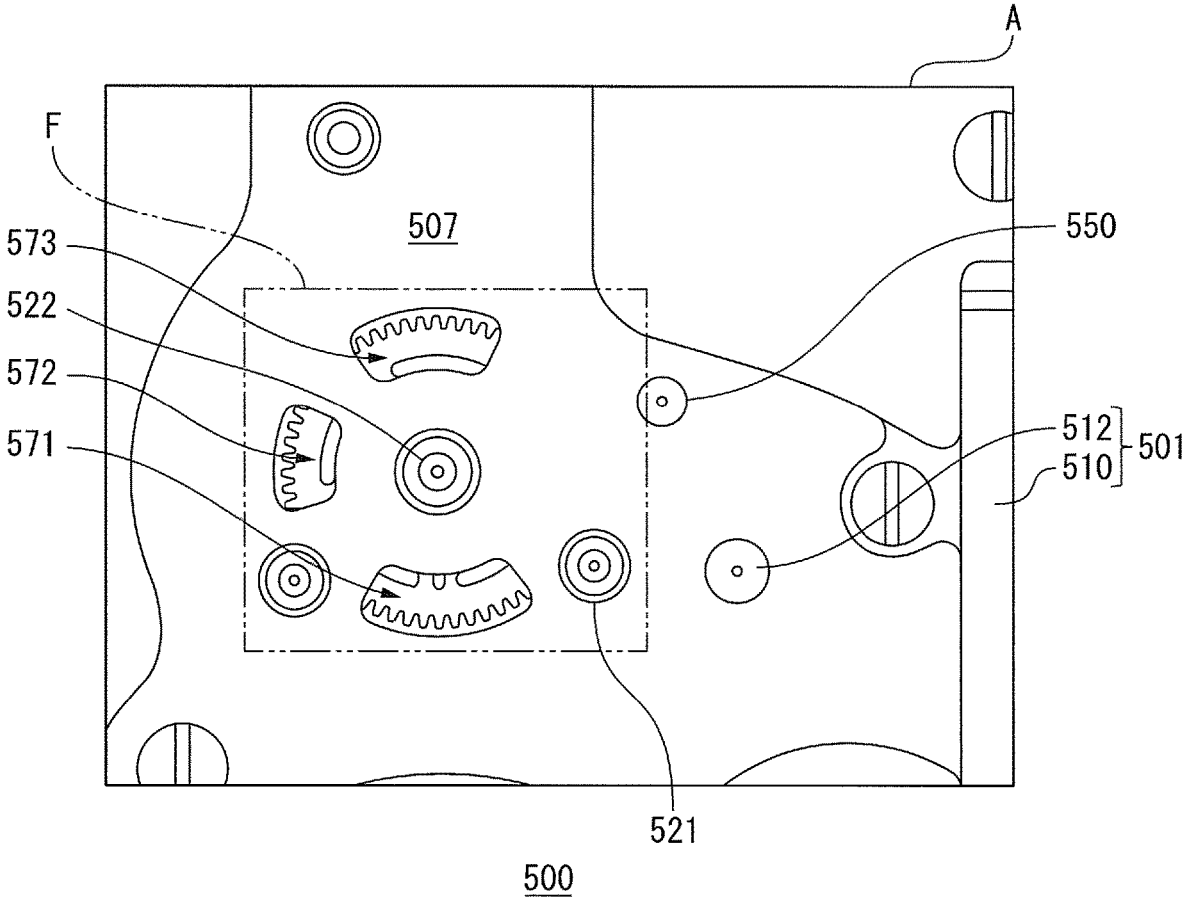
FIG. 18 is an enlarged view of an area indicated by an arrow A in FIG. 16.
Figure 19:
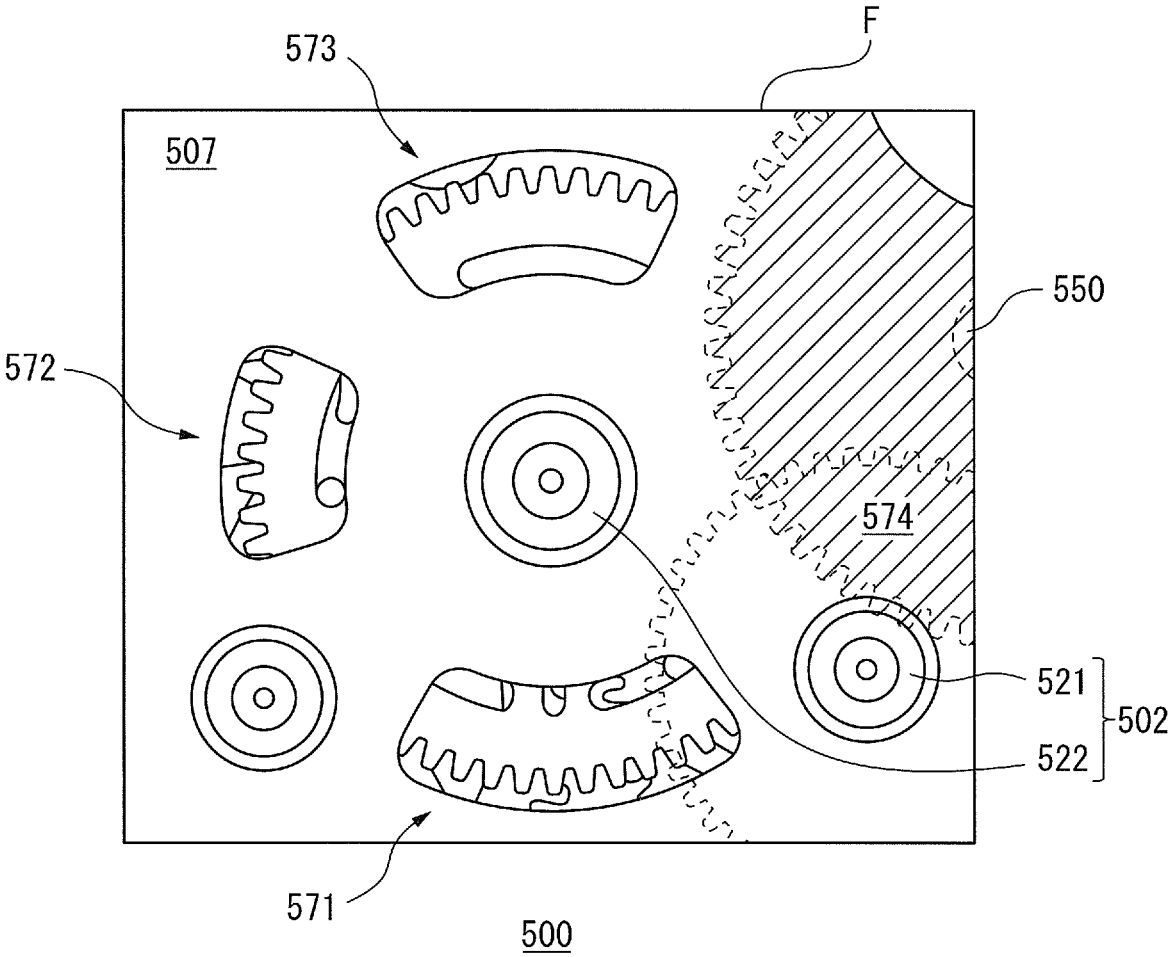
FIG. 19 is an enlarged view of an area indicated by an arrow F in FIG. 18.
Figure 20A:
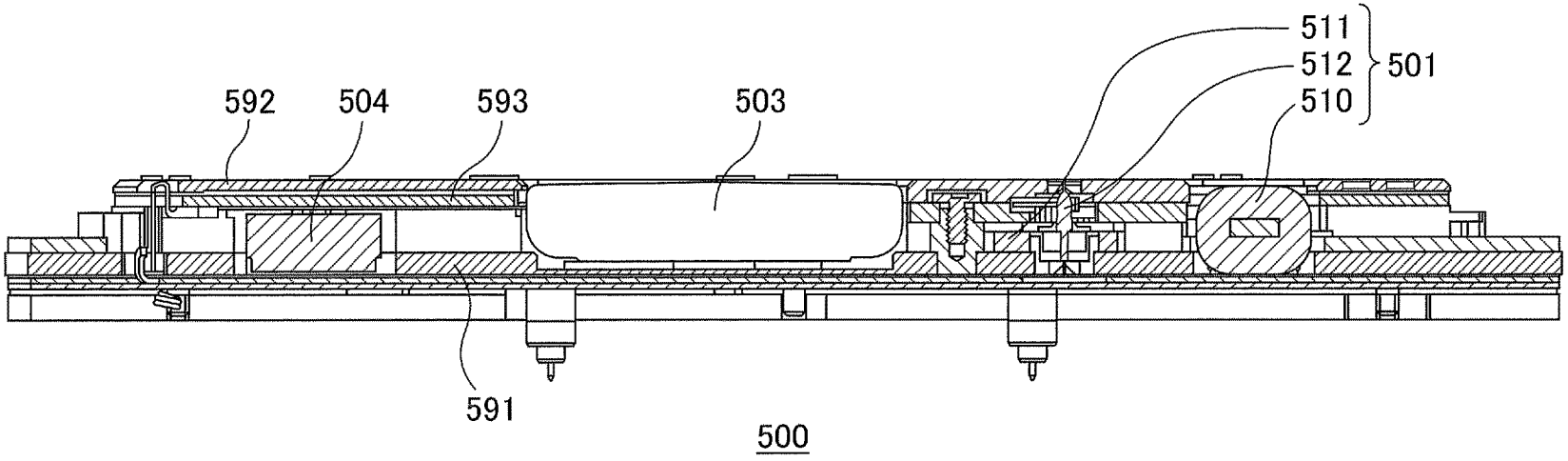
FIG. 20A is a cross-sectional view taken along a B-B line in FIG. 16.
Figure 20B:
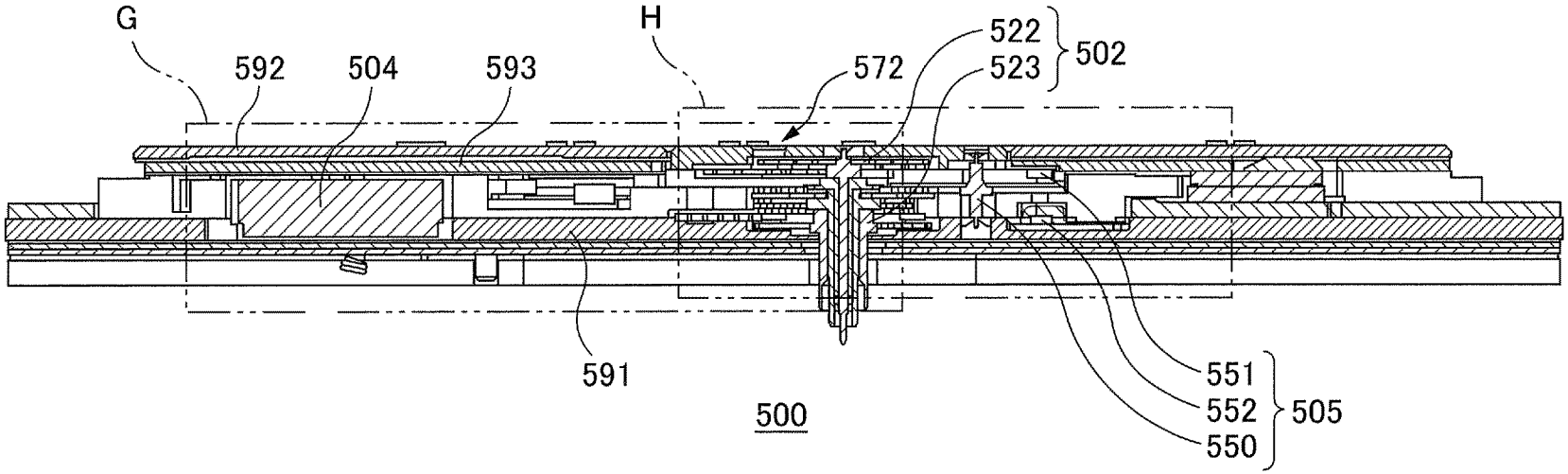
FIG. 20B is a cross-sectional view taken along an E-E line in FIG. 17.
Figure 21A:
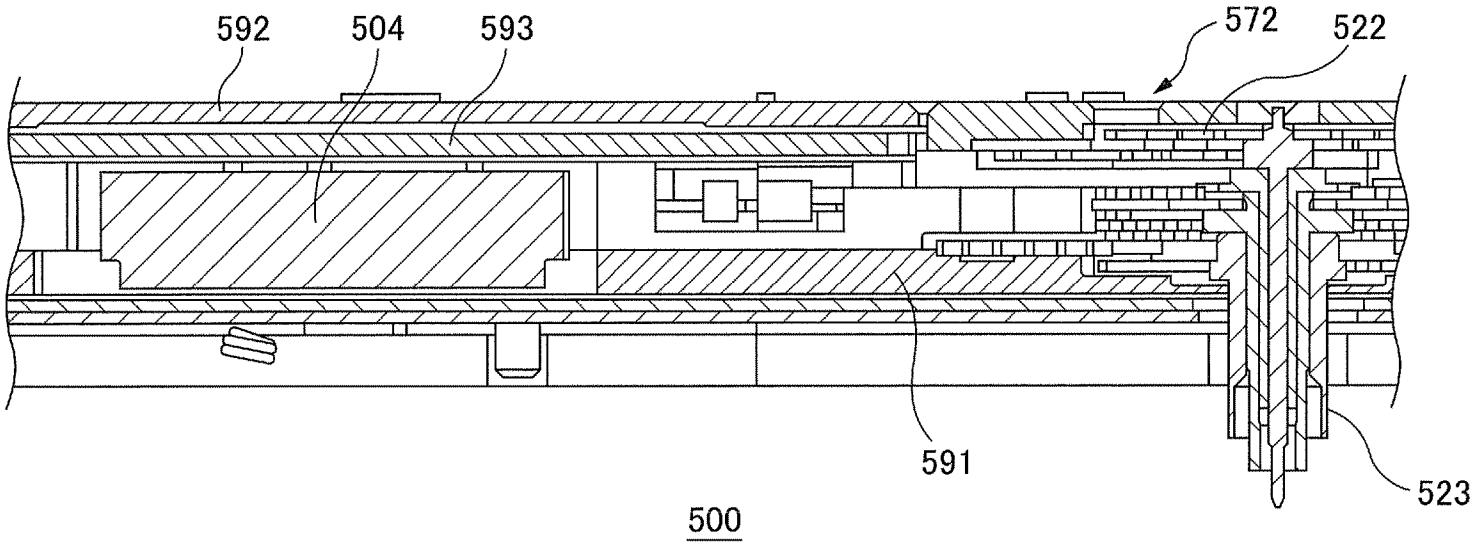
FIG. 21A is an enlarged view of an area indicated by an arrow Gin FIG. 20B.
Figure 21B:
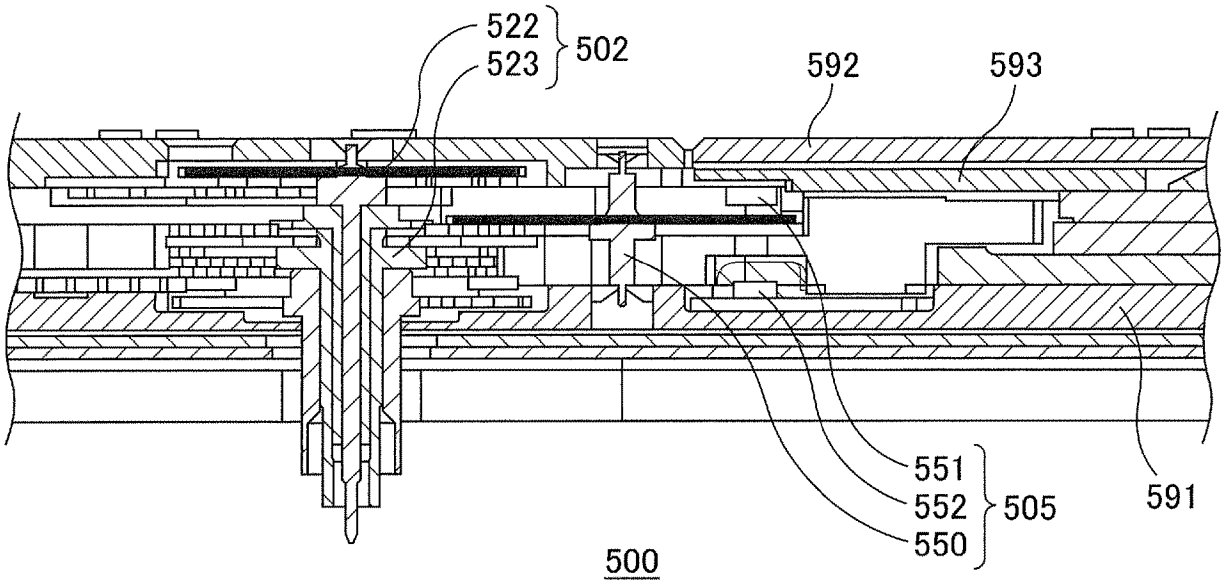
FIG. 21B is an enlarged view of an area indicated by an arrow H in FIG. 20B.

FIG. 16 is a rear view of an electronic watch according to still another embodiment, in which the back cover of the electronic watch is transparent, FIG. 17 is a perspective view of a wheel train of the electronic watch shown in FIG. 16, FIG. 18 is an enlarged view of the area indicated by an arrow A in FIG. 16, and FIG. 19 is an enlarged view of the area indicated by an arrow F in FIG. 18. FIG. 20A is a cross-sectional view taken along a B-B line in FIG. 16 and FIG. 20B is a cross-sectional view taken along an E-E line in FIG. 17. FIG. 21A is an enlarged view of the area indicated by an arrow G in FIG. 20B and FIG. 21B is an enlarged view of the area indicated by an arrow H in FIG. 20B. In FIG. 16, components that are not recognized visually by a circuit pressing plate and the wheel train bridge are indicated by broken lines.

An electronic watch 500 has a step motor 501, a wheel train 502, a battery 503, an oscillation device 504, a hand position detection mechanism 505, an electronic circuit 506, a wheel train bridge 507, and a winding stem 508. The electronic circuit 506 has a control circuit 561 and a function circuit 562. The step motor 501 to the winding stem 508 are mounted on a main plate 591 and accommodated in a case 590. The step motor 501, the wheel train 502, the oscillation device 504, the hand position detection mechanism 505, the electronic circuit 506, the wheel train bridge 507, and the winding stem 508 are included in the movement main body.

The step motor 501 is also referred to simply as a motor and has a coil 510, a stator 511, and a rotor 512. The step motor 501 drives the wheel train 502 based on a reference frequency signal generated by the oscillation device 504 and moves hands including an hour hand, a minute hand, and a second hand. The coil 10 produces a magnetic force by a pulse signal output from the function circuit 562 and rotates the rotor 512 by providing the magnetic force to the rotor 512 via the stator 511. The stator 511 is formed by a magnetic material, such as PC Permalloy and 42 Ni Permalloy.

The wheel train 502 has a plurality of wheels including a fifth wheel 521, a fourth wheel 522 to which the second hand is attached and also referred to as a second wheel, a center wheel to which the minute hand is attached, and an hour wheel 523 to which the hour hand is attached. The fifth wheel 521 is engaged with the rotor 512 and rotates in accordance with the rotation of the rotor 512. The fourth wheel 522 rotates in accordance with the rotation of the fifth wheel 521 and rotates the second hand attached to the fourth wheel 522. In accordance with the rotation of the fourth wheel 522, the minute hand attached to the center wheel and the hour hand attached to the hour wheel 523 rotate.

The battery 503 is, for example, a secondary battery, such as a coin-type lithium secondary battery, and the battery 503 is a power supply source that supplies power to the oscillation device 504, the control circuit 561, the function circuit 562, and so on.

Figure 22A:
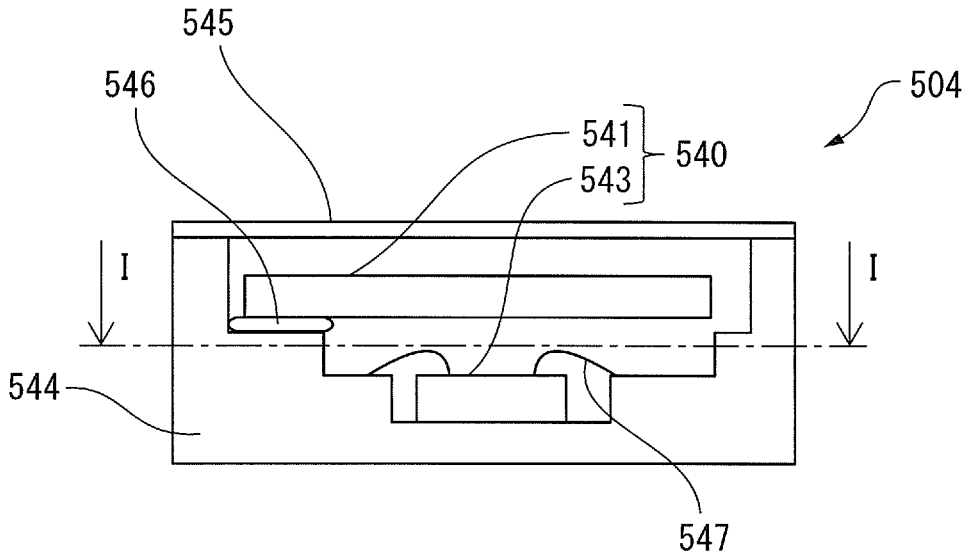
FIG. 22A is a cross-sectional view taken along a D-D line in FIG. 16.
Figure 22B:
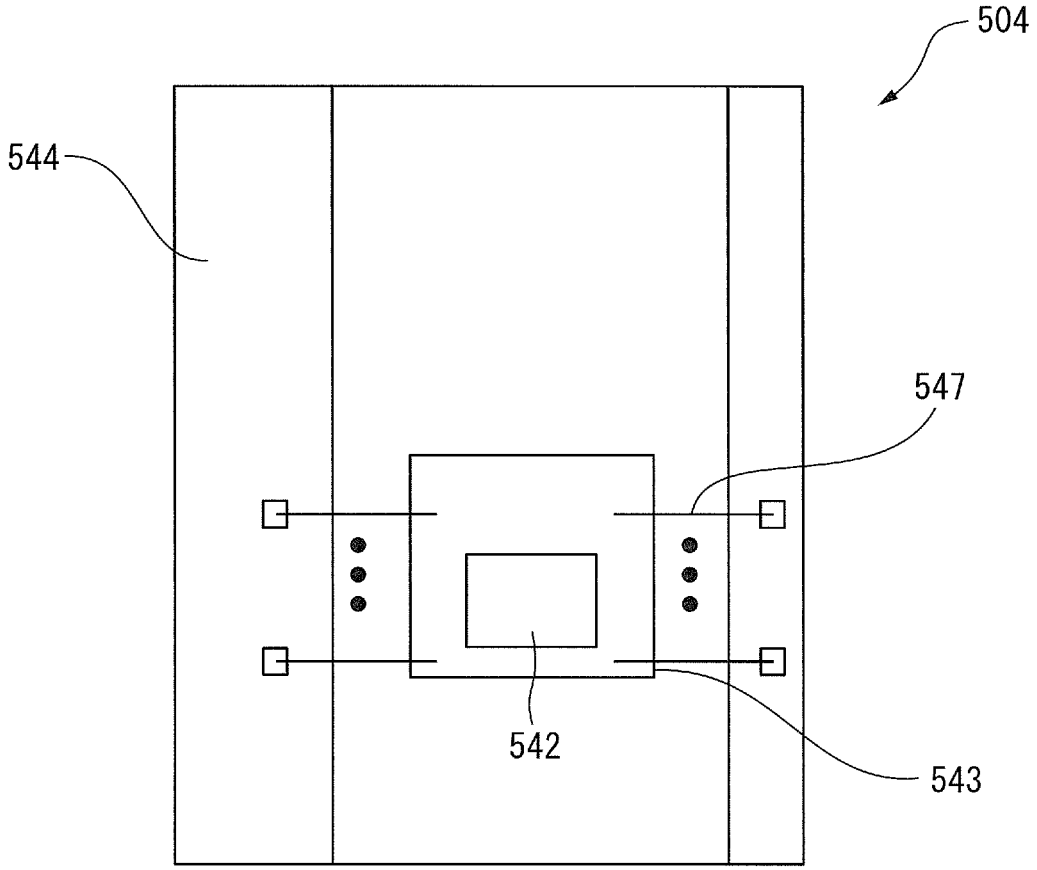
FIG. 22B is a cross-sectional view taken along an I-I line in FIG. 22A.

FIG. 22A is a cross-sectional view taken along a D-D line in FIG. 16 and FIG. 22B is a cross-sectional view taken along an I-I line in FIG. 22A.

The oscillation device 504 has a quartz crystal oscillator 541, a temperature detection element 542, a semiconductor circuit 543, a casing 544, and a lid 545 and is mounted on a circuit pressing plate 592 via a circuit substrate 593. The oscillation device 504 is arranged so as to overlap none of the step motor 501, the battery 503, and the winding stem 508 when the electronic watch 500 is viewed in a plan view.

The quartz crystal oscillator 541 is, for example, an AT oscillator and one end thereof is supported by the casing 544 by a supporting part 546, such as an electrically conductive adhesive. The quartz crystal oscillator 541 oscillates at a predetermined oscillation frequency in response to being supplied with a current from the semiconductor circuit 543 via the supporting part 546. The semiconductor circuit 543 incorporates the temperature detection element 542 and may detect a change in temperature inside the casing 544.

The semiconductor circuit 543 is a semiconductor circuit formed on a silicon substrate and generates a reference frequency signal based on the oscillation of the quartz crystal oscillator 541 by the supply of a current as well as supplying a current to the quartz crystal oscillator 541. The reference frequency signal generated by the semiconductor circuit 543 is output to the outside of the casing 544 via, for example, a wire 547 and a metal wire formed on the surface and the inside of the casing 544. The semiconductor circuit 543 forms an oscillation circuit 540 together with the quartz crystal oscillator 541.

Further, the semiconductor circuit 543 outputs a measured temperature signal to the control circuit 561.

The casing 544 and the lid 545 are accommodation members that is made by no-light transmitting material and do not transmit light and accommodate the quartz crystal oscillator 541, the temperature detection element 542, and the semiconductor circuit 543. The casing 544 is formed by performing molding processing for a synthetic resin that does not transmit light, such as an epoxy resin. In the casing 544, concave parts in which the quartz crystal oscillator 541 and the semiconductor circuit 543 are accommodated are formed. The lid 545 is formed by a metal or the like that does not transmit light and functions as a lid that covers the concave parts of the casing 544 in which the temperature detection element 542 and the semiconductor circuit 543 are accommodated.

The hand position detection mechanism 505 has a second position detection wheel 550, a light emitting element 551, and a light receiving element 552. In the second position detection wheel 550, a transmission part 553 that transmits light is formed and the second position detection wheel 550 rotates in response to the wheel train being driven. The second position detection wheel 550 rotates in response to the rotation of the fifth wheel 521. The transmission part 553 is a through hole indicating the reference position of the second position detection wheel 550.

The light emitting element 551 is, for example, an LED and radiates light to the transmission part 553 in response to a light emitting signal being input from the function circuit 562. The light receiving element 552 is, for example, a phototransistor and receives light radiated from the light emitting element 551 via the transmission part 553. The light receiving element 552 outputs a light reception signal indicating that the light radiated from the light emitting element 551 is received to the control circuit 561.

The electronic circuit 506 has the control circuit 561 and the function circuit 562 and is mounted on the circuit substrate 593 together with the oscillation device 504. The control circuit 561 is, for example, a CPU and generates a correction signal used for correction of the reference frequency signal from the temperature corresponding to the temperature signal input from the oscillation device 504 as well as controlling the entire operation of the electronic watch 500. Further, the control circuit 561 controls the function circuit 562 by outputting a counter reset signal or the like to the function circuit 562.

The function circuit 562 is a semiconductor circuit that is formed on the silicon substrate and generates a real time clock with which the step motor 501 is driven based on the reference frequency signal input from the oscillation device 504. The function circuit 562 has a counter circuit that counts the number of times the input reference frequency signals.

Figure 23:
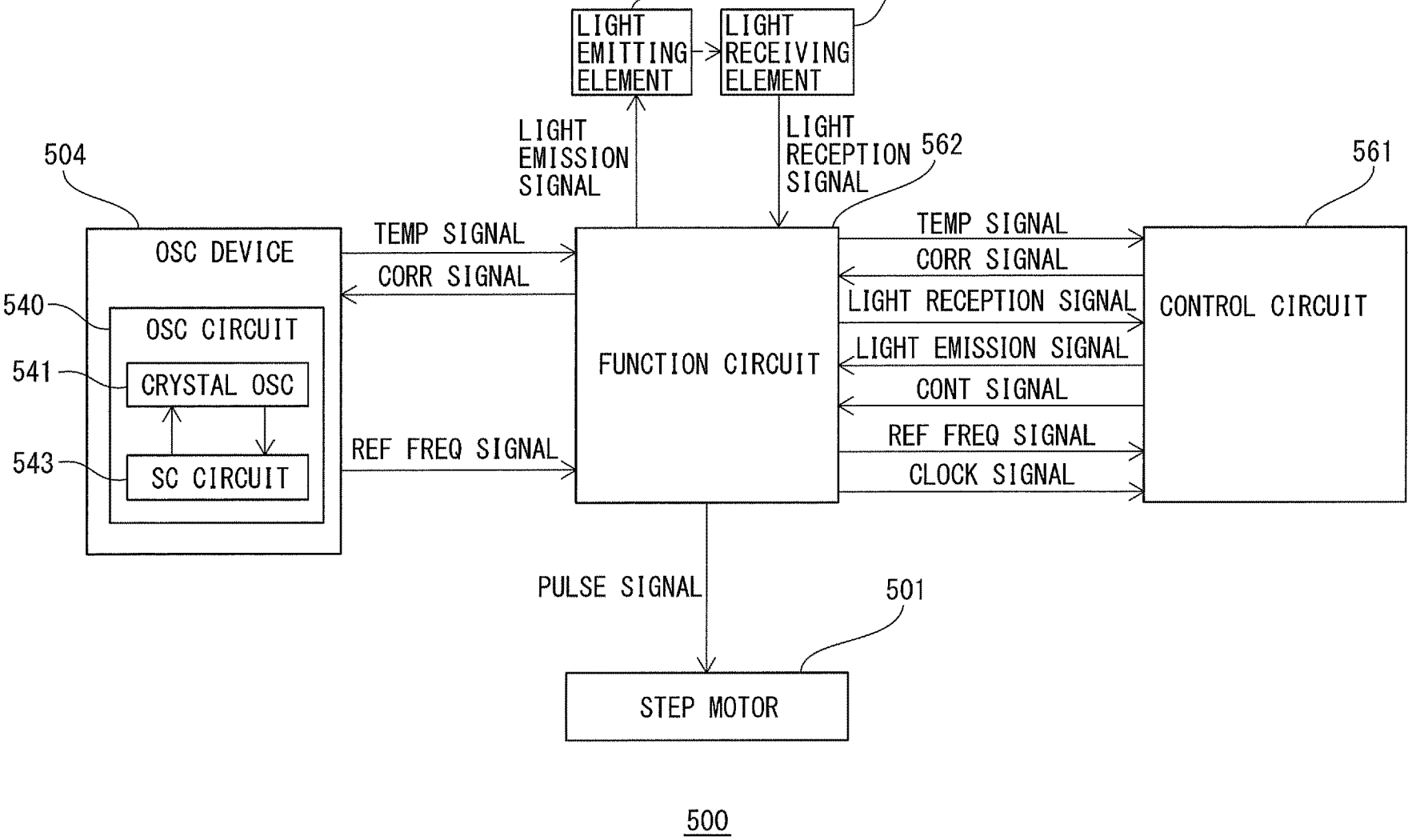
FIG. 23 is block view showing a connection relationship of components mounted on the electronic watch in FIG. 16.

FIG. 23 is a block view showing a connection relationship of the step motor 501, the oscillation device 504, the light emitting element 551, the light receiving element 552, the control circuit 561, and the function circuit 562.

The oscillation device 504 outputs a temperature signal indicating a temperature estimated by the semiconductor circuit 543 to the control circuit 561 via the function circuit 562. The control circuit 561 generates a correction signal used for correction of the reference frequency signal from the temperature corresponding to the temperature signal input from the oscillation device 504 and outputs the generated correction signal to the oscillation device 504 via the function circuit 562.

Further, the semiconductor circuit 543 generates a reference frequency signal based on the oscillation of the quartz crystal oscillator 541, which occurs by being supplied with a current. When the semiconductor circuit 543 generates the reference frequency signal, the semiconductor circuit 543 corrects the reference frequency signal so as to reduce the influence by temperature based on the correction signal input from the control circuit 561. The oscillation device 504 outputs the reference frequency signal generated by the semiconductor circuit 543 to the function circuit 562. The function circuit 562 generates a clock signal by driving the real time clock that counts time based on the reference frequency signal input from the oscillation device 504 and outputs clock information to the control circuit 561 and at the same time, outputs a pulse signal that drives the step motor 501 every second to the step motor 501. The step motor 501 drives the wheel train 502 in accordance with the pulse signal input from the function circuit 562, and moves the hand.

The control circuit 561 outputs a light emission signal indicating that the light emitting element 551 is caused to emit light to the light emitting element 551 via the function circuit 562. Further, the control circuit 561 inputs via the function circuit 56 a light reception signal indicating that the light radiated from the light emitting element 551 is received. The control circuit 561 estimates the position of the second position detection wheel 550 based on the timing at which a light reception signal is input and controls the movement of the hand based on the estimated position of the second position detection wheel 550. The control circuit 561 outputs a counter reset signal to reset the counter circuit possessed by the function circuit 562 and a control signal including a hand movement signal to give instruction to start and suspend the movement of the hand, or the like to the function circuit 562. The function circuit 562 controls the step motor 501 in accordance with the control signal input from the control circuit 561.

In the wheel train bridge 507, a first hole 571, a second hole 572, and a third hole 573, each transmitting light, are formed and the wheel train bridge 507 holds the wheel train 502. A reflection suppression layer on which incident light reflects is not easily formed on the surface of the wheel train bridge 507 by surface processing to plate the surface of the wheel train bridge 507 black with black nickel plate, black ruthenium plate, DLC, and so on.

Each of the first hole 571, the second hole 572, and the third hole 573 is formed at the position at which the gear of the fourth wheel 522 may be visually recognized. The first hole 571 is formed between the axis of the fourth wheel 522 and the battery 503, the second hole 572 is formed between the axis of the fourth wheel 522 and the function circuit 562, and the third hole 573 is formed at the position in opposition to the position of the first hole 571 via the axis of the fourth wheel 522.

On the other hand, no holes transmitting light are formed in an overlap part 574 on the wheel train bridge 507, where the wheel train bridge 507 overlaps the second position detection wheel 550 when the electronic watch 500 is viewed in a plan view. The overlap part 574 is shown with hatching. On the other hand, each of the first hole 571, the second hole 572, and the third hole 573 that transmit light is formed at the portions other than the overlap part 574.

The winding stem 508 is a member, on one end of which, the operation part is arranged and with the other end of which, a sliding wheel is engaged, and which rotates the center wheel and the hour wheel 523 in response to the operation part being operated.

In the electronic watch 500, the quartz crystal oscillator 541 and the semiconductor circuit 543 forming the oscillation circuit 540 are accommodated in an accommodation member that does not transmit light, and therefore even if, for example, the back cover is made of glass, which is a light transmitting member, so that the rotation of the fourth wheel may be visually recognized, the likelihood that the light having entered the inside via the first hole 571 to the third hole 573 reaches the semiconductor circuit 543 is low. In the electronic watch 500, since the likelihood that light reaches the semiconductor circuit 543 is low, the likelihood that the characteristics of the oscillation circuit 540 change due to the irradiation with light is low. In the electronic watch 500, since the likelihood that the characteristics of the oscillation circuit 540 change due to the irradiation with light is low, the likelihood that the rate changes due to the light having entered the inside via the first hole 571 to the third hole 573 is low.

Figure 24:
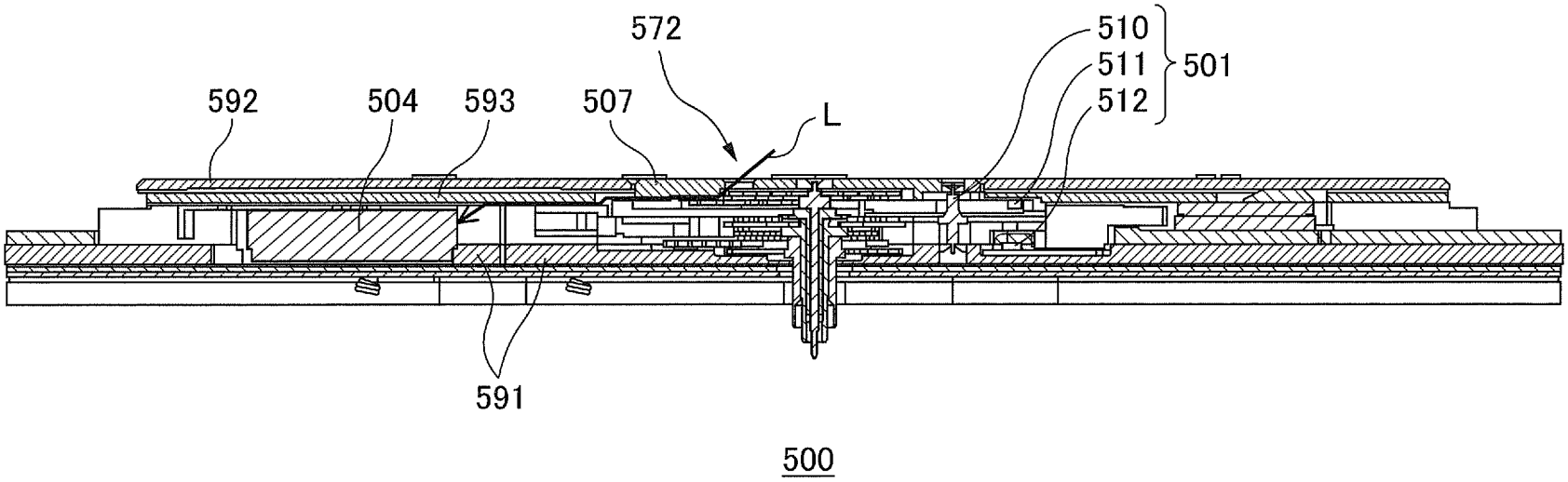
FIG. 24 is a cross-sectional view taken along a C-C line in FIG. 16.

FIG. 24 is a cross-sectional view taken along a C-C line in FIG. 16.

For example, when the back cover is made of glass, which is a light transmitting member, light L having entered the inside of the electronic watch 500 from the first hole 571 to the third hole 573 reaches the oscillation device 504 while reflecting from the wheel train bridge 507, the main plate 591, the circuit pressing plate 592, the circuit substrate 593, and so on. However, the quartz crystal oscillator 541 and the semiconductor circuit 543 forming the oscillation circuit 540 are accommodated in the casing 544 and the lid 545, which are an accommodation member that does not transmit light, and therefore the likelihood that light reaches the quartz crystal oscillator 541 and the semiconductor circuit 543 is low. In the electronic watch 500, the likelihood that light reaches the semiconductor circuit 543 is low, and therefore the likelihood that the characteristics of the oscillation circuit 540 change due to the irradiation with light is low.

Further, in the electronic watch 500, since a reflection suppression layer that absorbs incident light without reflecting the incident light is formed on the surface of the wheel train bridge 507 and the main plate 591 by the black surface processing, the likelihood that the light having entered the inside via the first hole 571 to the third hole 573 reaches the oscillation device 504 is low. In the electronic watch 500, since the likelihood that the light having entered reaches the oscillation device 504 is low, even if the casing 544 that accommodates the semiconductor circuit 543 is thin and likely to transmit light, the likelihood that the characteristics of the oscillation circuit 504 change due to the irradiation with light is low. In the electronic watch 500, the likelihood that the characteristics of the oscillation circuit 540 change due to the irradiation with light is low, and therefore the likelihood that the rate changes due to the light having entered the inside via the first hole 571 to the third hole 573 is low.

Further, in the electronic watch 500, since the semiconductor circuit 543 that measures the temperature used for the correction of the reference frequency signal is accommodated inside the casing 544 together with the quartz crystal oscillator 541, the temperature measured by the semiconductor circuit 543 and the temperature of the quartz crystal oscillator 541 become approximately the same. In the electronic watch 500, the temperature measured by the temperature detection element 542 and the temperature of the quartz crystal oscillator 541 become approximately the same, and therefore the correction error that occurs due to the correction processing by the semiconductor circuit 543 may be minimized.

Further, in the electronic watch 500, by being accommodated inside the casing 544, the quartz crystal oscillator 541 is arranged in an environment isolated from the peripheral environment of the electronic watch 500, and therefore the quartz crystal oscillator 541 may reduce the influence of the peripheral environment condition of the electronic watch 500, such as humidity.

Further, in the electronic watch 500, when the electronic watch 500 is viewed in a plan view, the oscillation device 504 including the oscillation circuit 540 is arranged so as to overlap none of the step motor 501, the battery 503, and the winding stem 518, and therefore the thickness of the electronic watch 500 may be reduced.

Further, in the electronic watch 500, the first hole 571 to the third hole 573 that transmit light are not formed in the overlap part 574 that overlaps the second position detection wheel 550 when the electronic watch 500 is viewed in a plan view. In the electronic watch 500, the first hole 571 to the third hole 573 are not formed in the overlap part 574, and therefore the likelihood is low that the light receiving element 552 receives the light having transmitted the first hole 571 to the third hole 573 and the hand position detection mechanism 505 malfunctions.

Further, in the electronic watch 500, since the reflection suppression layer is formed on the surface of the wheel train bridge 507 and the main plate 591 by the black surface processing, the likelihood is low that the light receiving element 552 receives the light having transmitted the first hole 571 to the third hole 573 and the hand position detection mechanism 505 malfunctions.

The configurations explained above bring about the effect particularly for the light that enters from the outside of the case 590, when the back cover is formed by glass, which is a light transmitting member. However, even if a member that does not transmit light is used for the back cover, it is effective to adopt these configurations to remove light other than that emitted from the light emitting element 551 and strayed light.

The embodiments of the electronic watch are explained, but the present disclosure is not limited to the above-described embodiments. A person skilled in the art may modify the above-described embodiments as necessary.

Further, a person skilled in the art may incorporate a feature included in one embodiment into another embodiment unless a contradiction occurs. Alternatively, a person skilled in the art may exchange a feature included in one embodiment with a feature included in another embodiment.

For example, in the above-described embodiments, as the backing plate manufactured by a ferromagnetic metal, the solar cell backing plate 22 is illustrated. However, another backing plate that positions and/or supports the other components of the movement may be manufactured by a ferromagnetic metal.

What is claimed is:

1. An electronic watch having a movement, the movement comprising:

a movement main body;

a plate manufactured by a ferromagnetic metal; and a hook having flexibility higher than that of the plate, wherein the plate includes an engagement part that protrudes from the rear surface of the plate and which is configured to accommodate one end part of the hook, and the hook includes a first portion arranged at one end part of the hook and including a protruding part accommodated by the engagement part, a second portion arranged at the other end part of the hook and fixed to the movement main body, and a curved part having U-letter shape.

2. The electronic watch according to claim 1, wherein the movement main body has a motor, and the plate and at least a part of the motor of the movement main body are arranged in an overlapping manner when viewed from a direction perpendicular to the rear surface of the plate.

3. The electronic watch according to claim 2, wherein the motor has a stator provided with a pair of slits, and the engagement part is arranged in a vertical direction to a line connecting between the pair of slits when viewed from a normal direction of the plate.

4. The electronic watch according to claim 1, wherein the hook has flexibility higher than that of the engagement part.

5. The electronic watch according to claim 1, wherein the plate supports a solar cell.

6. The electronic watch according to claim 1, wherein the movement further comprises a spring member that electrically connects a circuit substrate of the movement main body and the plate.

7. The electronic watch according to claim 1, wherein the other end part of the hook is sandwiched and fixed between two insulating members of the movement main body.

8. The electronic watch according to claim 1, wherein the other end part of the hook is formed into one unit together with an insulating member of the movement main body.

9. The electronic watch according to claim 1, wherein the movement main body includes, a wheel train, a wheel train bridge in which a hole that transmits light is formed and which holds the wheel train, an oscillation circuit that generates a reference frequency signal indicating a reference frequency, a motor that drives the wheel train based on the reference frequency signal generated by the oscillation circuit, an accommodation member accommodating the oscillation circuit and that does not transmit light.

10. The electronic watch according to claim 9, further comprising:

a battery that supplies power to the oscillation circuit, wherein the oscillation circuit is arranged so as to overlap none of the motor and the battery when viewed in a plan view.

11. The electronic watch according to claim 10, wherein the movement main body further includes a winding stem driving the wheel train, and the oscillation circuit is arranged so as not to overlap the winding stem when viewed in a plan view.

12. The electronic watch according to claim 9, wherein the oscillation circuit includes a quartz crystal oscillator and a semiconductor circuit that generates the reference frequency signal based on oscillation of the quartz crystal oscillator as well as supplying a current to the quartz crystal oscillator, and both the quartz crystal oscillator and the semiconductor circuit are accommodated by the accommodation member.

13. The electronic watch according to claim 9, wherein on the surface of the wheel train bridge, a reflection suppression layer is formed by surface processing with one of black nickel plate, black ruthenium plate, DLC coating.

14. The electronic watch according to claim 1, wherein the movement main body includes, a wheel train, a wheel train bridge that holds the wheel train, and a hand position detection mechanism having a position detection gear in which a transmission part that transmits light is formed and which rotates in response to the wheel train being driven, a light emitting element that radiates light to the transmission part, and a light receiving element that receives light radiated from the light emitting element via the transmission part, wherein in the wheel train bridge, a hole that transmits light is not formed in an overlap part that overlaps the position detection gear when viewed in a plan view and the hole is formed in a portion other than the overlap part.

15. The electronic watch according to claim 14, wherein on the surface of the wheel train bridge, a reflection suppression layer is formed by surface processing with one of black nickel plate, black ruthenium plate, DLC coating.

16. The electronic watch according to claim 15, wherein the reflection suppression layer is formed by surface processing with the black plate.

17. An electronic watch comprising a movement, wherein the movement has:

a movement main body;

a plate manufactured by a ferromagnetic metal; and a hook having higher flexibility than that of the plate, the plate includes an engagement part that protrudes from the rear surface of the plate and which is configured to accommodate one end part of the hook the one end part of the hook is configured to be accommodated by the engagement part by elastically deforming the hook and the other end part of the hook is fixed to the movement main body, and the other end part of the hook is fixed between a circuit substrate and an insulating member of the movement main body, and the hook is adjacently arranged so as to contact with the insulating member.

* * * * *